US012203664B2

(12) United States Patent
Mun et al.

(10) Patent No.: US 12,203,664 B2
(45) Date of Patent: Jan. 21, 2025

(54) INDOOR UNIT OF AN AIR CONDITIONER

(71) Applicant: LG ELECTRONICS INC., Seoul (KR)

(72) Inventors: Seongkuk Mun, Seoul (KR); Junseok Bae, Seoul (KR); Kangyoung Kim, Seoul (KR); Hakjae Kim, Seoul (KR); Eunsun Lee, Seoul (KR); Taeyun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/597,731

(22) Filed: Mar. 6, 2024

(65) Prior Publication Data

US 2024/0210044 A1 Jun. 27, 2024

Related U.S. Application Data

(63) Continuation of application No. 16/978,565, filed as application No. PCT/KR2019/002682 on Mar. 7, 2019, now Pat. No. 11,953,214.

(30) Foreign Application Priority Data

Mar. 7, 2018 (KR) ..... 10-2018-0027005
Feb. 14, 2019 (KR) ..... 10-2019-0017450

(51) Int. Cl.
*F24F 1/0018* (2019.01)
*F24F 1/0007* (2019.01)
(Continued)

(52) U.S. Cl.
CPC ..... *F24F 1/0018* (2013.01); *F24F 1/0007* (2013.01); *F24F 1/0011* (2013.01);
(Continued)

(58) Field of Classification Search
CPC ..... F24F 1/0007; F24F 1/0011; F24F 1/0018; F24F 1/0022; F24F 1/0029; F24F 11/79; F24F 13/10; F24F 13/12
See application file for complete search history.

(56) References Cited

FOREIGN PATENT DOCUMENTS

KR 10-2014-0012437 A 2/2014
KR 10-2016-0051095 A 5/2016

OTHER PUBLICATIONS

KR 2014-0019106 (English Translation) (Year: 2014).*

* cited by examiner

*Primary Examiner* — Jonathan Bradford
(74) *Attorney, Agent, or Firm* — BRYAN CAVE LEIGHTON PAISNER LLP

(57) ABSTRACT

An air conditioner may provide a fan housing assembly that moves in the front-rear direction by the operation of an actuator, and the fan housing assembly moves so as to pass through a front outlet arranged on a door assembly to be in a projected state, and the front end of the fan housing assembly protrudes further to the front than the front surface of the door assembly; and through the projected state, may provide conditioned air by a direct air flow to a long-distance target region. The configuration may enable the minimization of interference between the discharged air and the door assembly, and the minimization of flow loss of the discharged air since, when the fan housing assembly is in the projected state, a steering grill is in a state of protruding to the outside of the door assembly by passing through the front outlet.

10 Claims, 27 Drawing Sheets

(51) Int. Cl.

| | |
|---|---|
| ***F24F 1/0011*** | (2019.01) |
| ***F24F 1/0029*** | (2019.01) |
| ***F24F 1/005*** | (2019.01) |
| ***F24F 13/08*** | (2006.01) |
| ***F24F 13/14*** | (2006.01) |

(52) U.S. Cl.

CPC ..... *F24F 1/0029* (2013.01); *F24F 1/005* (2019.02); *F24F 13/082* (2013.01); *F24F 13/1426* (2013.01); *F24F 2013/1446* (2013.01); *F24F 2013/146* (2013.01)

3430

1070

1080

INDOOR UNIT OF AN AIR CONDITIONER

CROSS-REFERENCE TO RELATED APPLICATIONS

This application is a Continuation Application of U.S. patent application Ser. No. 16/978,565, filed Sep. 4, 2020, which is a National Stage of International Application No. PCT/KR2019/002682, filed on Mar. 7, 2019 which claims the benefit of Korean Application No. 10-2019-0017450, filed on Feb. 14, 2019, and Korean Application No. 10-2018-0027005, filed on Mar. 7, 2018, the contents of which are all hereby incorporated by reference herein in their entirety.

TECHNICAL FIELD

The present disclosure relates to an indoor unit of an air conditioner, and more particularly, to an indoor unit of an air conditioner including a long-distance fan assembly moving in a forward and rearward direction to be exposed to an outside of a cabinet assembly.

BACKGROUND ART

A split-type air conditioner may include an indoor unit disposed in an indoor space and an outdoor unit disposed in an outdoor space and may cool, heat, or dehumidify indoor air through refrigerants circulating between the indoor unit and the outdoor unit.

Examples of indoor unit of the split-type air conditioner include a stand-type indoor unit vertically installed on the indoor floor, a wall-mounted indoor unit mounted on the indoor wall, and a ceiling-type indoor unit mounted on the indoor ceiling.

There is a problem in that, as the indoor unit of the split-type air conditioner in related art includes an indoor fan disposed inside a cabinet, conditioned air may not be remotely discharged.

According to Korean Patent No. 10-1191413, a circulator remotely flows air around the indoor unit.

According to Korean Patent No. 10-1191413, an air circulator is disposed in the indoor unit and may not directly flow the conditioned air and may remotely flow indoor air above the indoor unit.

As the air circulator does not directly flow the conditioned air, there is a problem in that the air circulator may not supply the conditioned air to a target area in concentration and may not selectively condition the target area where temperature imbalance is generated.

According to Korean Patent Publication No. 10-2017-0010293, a cabinet of an indoor unit defines an opening and includes a door unit to open and close the opening. According to Korean Patent Publication No. 10-2017-0010293, the door unit is movable in a forward and rearward direction, and when the indoor unit is not operated, the door unit closes the opening, and when the indoor unit is operated, the door unit is moved forward to open the opening.

However, according to Korean Patent Publication No. 10-2017-0010293, a door unit moves in a forward and rearward direction to open and close an opening, but as the door unit is disposed in front of the opened opening, the door unit blocks the flow of air discharged through the opening. For example, according to Korean Patent Publication No. 10-2017-0010293, the opening opened by the door unit is not suitable for remotely flowing the air.

In addition, according to Korean Patent Publication No. 10-2017-0010293, the door is moved forward to open the opening, and as a blowing fan is disposed inside an exterior panel, the air expelled by the blowing fan generates resistance to a structure inside the exterior panel, which causes a lot of flow loss to remotely flowing the air.

SUMMARY

The present disclosure provides an indoor unit of an air conditioner to provide conditioned air to a remote target area with direct air flow.

The present disclosure provides an indoor unit of an air conditioner to minimize flow resistance between direct air flow and a cabinet assembly when the indoor unit provides the direct air flow to a target area.

The present disclosure provides an indoor unit of an air conditioner to move a fan housing assembly forward or rearward to pass through a front discharge outlet provided in a door assembly.

The present disclosure provides an indoor unit of an air conditioner to protrude the fan housing assembly out of a cabinet assembly to discharge conditioned air with direct air flow.

The present disclosure provides an indoor unit of an air conditioner to protrude the fan housing assembly outward through a door assembly defining the front discharge outlet.

The present disclosure provides an indoor unit of an air conditioner to protrude the fan housing assembly out of the cabinet assembly when in operation and conceal the fan housing assembly inside the cabinet assembly when not in operation.

The present disclosure provides an indoor unit of an air conditioner to provide conditioned air from an inside of a cabinet assembly to a steering grill protruding out of the cabinet assembly through an independent flow path.

Technical Solution

According to the present disclosure, an air conditioner may provide a projection state in which a fan housing assembly moves in a forward and rearward direction based on operation of an actuator, and the fan housing assembly moves to pass through a front discharge outlet provided on a door assembly, and a front end of the fan housing assembly further protrudes from a front surface of the door assembly, and may provide conditioned air by a direct air flow to a long-distance target region, in the projection state.

According to the present disclosure, the fan housing assembly may protrude out of the cabinet assembly during operation and the fan housing assembly may be concealed inside the cabinet assembly when not in operation.

According to the present disclosure, the fan housing assembly includes a steering grill to discharge air, and in the projection state, the steering grill may pass through the front discharge outlet, and the front end of the steering grill protrude further forward than the front surface of the door assembly, and may minimize flow resistance between the direct air flow discharged by the steering grill and the cabinet assembly.

According to the present disclosure, the fan housing is inserted into the door assembly in the projection state to minimize leakage of air inside the fan housing into the cabinet assembly.

According to the present disclosure, a suction inlet is disposed on a rear surface of the cabinet assembly and a heat exchange assembly is disposed in front of the suction inlet to allow air suctioned from the rear to straightly move forward, thereby minimizing air flow resistance.

The guide housing is disposed in front of the heat exchange assembly, may guide the fan housing assembly in the forward and rearward direction, and even when the fan housing assembly is moved, the air suctioned from the rear may flow in a forward direction, thereby minimizing the air flow resistance.

The guide housing further includes: a guide housing suction inlet opened towards the heat exchange assembly, the air guide is made of elastic material, and connects the guide housing suction inlet to the fan suction inlet, and the guide housing may guide, to the fan suction inlet, the air suctioned through the guide housing suction inlet. The air guide may be expanded or contracted when the fan housing assembly moves in the forward and rearward direction and may provide an independent flow path between the guide housing suction inlet and the fan housing assembly.

The guide housing further includes a guide housing suction inlet opened towards the heat exchange assembly, the fan suction inlet has a diameter smaller than a diameter of the guide housing suction inlet, and the air flows from a larger area to a smaller area to obtain flow rate of conditioned air.

The fan housing assembly is moved forward and rearward along a central axis (C1) connecting a center of the guide housing suction inlet to a center of the front discharge outlet to prevent a phenomenon in which the fan housing assembly is engaged with the door assembly and is not inserted into the front discharge outlet, when moving forward.

The center of the guide housing suction inlet corresponds to the center of the front discharge outlet in the forward and rearward direction to minimize flow loss generated during air flow.

The guide housing further includes a guide housing suction inlet opened towards the heat exchange assembly, the guide housing suction inlet is disposed in front of the heat exchange assembly, and the guide housing suction inlet may have a front surface facing a front surface of the heat exchange assembly. The guide housing suction inlet has the front surface facing the front surface of the heat exchange assembly to minimize flow loss generated when the conditioned air flows into the guide housing suction inlet.

The indoor unit of the air conditioner further includes a guide groove defined on an inner surface of the guide housing; and a guide roller disposed in the fan housing assembly. When the fan housing assembly moves, the guide roller is supported by the guide groove and may move along the guide groove. The guide roller supports load of the fan housing assembly to reduce operating load of the actuator.

The actuator may move the fan housing assembly forward or rearward through the engagement between guide gears and racks.

The actuator may include a guide motor disposed in the fan housing assembly and configured to provide a driving force to move the fan housing assembly in the forward and rearward direction; a guide shaft horizontally disposed on the fan housing assembly, rotatably assembled to the fan housing assembly, and rotated by receiving a rotational force of the guide motor; a guide gear coupled to the left side of the guide shaft; a second guide gear coupled to the right side of the guide shaft and rotated together with the guide shaft; a first rack disposed on the guide housing and engaged with the first guide gear; and a second rack disposed on the guide housing and engaged with the second guide gear. When the guide motor is operated, the first guide gear is moved along the first rack when the first guide gear is engaged with the first rack and the second guide gear is moved along the second rack when the second guide gear is engaged with the second rack to distribute the load of the fan housing assembly and reduce the operating load applied to each of the first guide gear and the second guide gear.

As the first rack is disposed under the first guide gear and the second rack is disposed under the second guide gear, the first rack and the second rack may each have a length, which is longer in a forward and rearward direction than an actual forward or rearward movement length to maintain the engaged rack and guide gear even when the fan housing assembly moves further than usual.

The first rack and the second rack are each disposed below the front discharge outlet to prevent interference with discharged air flow and exposure to outside through the front discharge outlet.

When viewed from the front, the first rack and the second rack are disposed bilaterally symmetrical to each other with respect to a central axis (C1) passing a center of the front discharge outlet in the forward and rearward direction to laterally balance it when the fan housing assembly moves forward or rearward and prevent the occurrence of eccentricity on either side during the movement.

When viewed from the front, the first guide gear and the second guide gear are disposed bilaterally symmetrical to each other with respect to the central axis (C1) passing the center of the front discharge outlet in the forward and rearward direction to laterally balance it when the fan housing assembly moves forward or rearward and prevent the occurrence of eccentricity on either side during the movement.

The indoor unit of the air conditioner further includes a stopper disposed in the guide housing, interfering with the fan housing assembly when the fan housing assembly is moved forward, and to limit the forward movement of the fan housing assembly, thereby preventing collision with the door assembly caused by excessive forward movement of the fan housing assembly.

The indoor unit of the air conditioner further includes a guide rail disposed between the fan housing assembly and the guide housing, configured to provide rolling friction and reduce the friction when the fan housing assembly is moved. The guide rail includes a long rail housing disposed in the guide housing and extending longitudinally in a forward and rearward direction; a short rail housing disposed in the fan housing assembly, extending longitudinally in the forward and rearward direction, and having a length less than a length of the long rail housing; and a bearing housing disposed between the long rail housing and the short rail housing, assembled to be movable relative to each of the long rail housing and the short rail housing in the forward and rearward direction, and when the short rail housing is moved, to provide rolling friction to each of the long rail housing and the short rail housing and provides a structure in which the bearing housing may be moved relative to each of the long rail housing and the short rail housing.

The indoor unit of the air conditioner includes a first guide rail disposed between the left side of the fan housing assembly and the guide housing and configured to provide rolling friction and reduce the friction when the fan housing assembly moves; and a second guide rail disposed between the right side of the fan housing assembly and the guide housing and configured to provide rolling friction and reduce the friction when the fan housing assembly moves, thereby distributing the load of the fan housing assembly to the guide housing using each of the first guide rail and the second guide rail.

When viewed from the front, the first guide rail and the second guide rail are disposed bilaterally symmetrical to each other with respect to the central axis (C1) passing the center of the front discharge outlet in the forward and rearward direction to laterally balance it when the fan housing assembly moves forward or rearward and prevent the occurrence of eccentricity on either side during the movement.

Advantageous Effects

According to the present disclosure, an indoor unit of an air conditioner has one or more effects as follows.

First, for the air conditioner according to the present disclosure, there is an advantage in that a fan housing assembly is moved in a forward and rearward direction based on operation of an actuator, the fan housing assembly is moved through a front discharge outlet defined in a door assembly, the fan housing assembly provides a projection state in which a front end of the fan housing assembly protrudes further forward than a front surface of the door assembly, and the indoor unit of the air conditioner may provide conditioned air to a remote target area with direct air flow, in the projection state.

Second, according to the present disclosure, there is an advantage in that the indoor unit of the air conditioner may provide the conditioned air to the fan housing assembly moving forward or rearward in the cabinet assembly through an independent flow path.

Third, according to the present disclosure, there is an advantage in that, when the fan housing assembly is in the projection state, flow resistance between the direct air flow discharged by the steering grill and a cabinet assembly may be minimized.

Fourth, according to the present disclosure, there is an advantage in that the steering grill protrudes out of the door assembly through a front discharge outlet to discharge the air to an indoor space, thereby minimizing flow loss of the discharged air.

Fifth, according to the present disclosure, there is an advantage in that the steering grill protrudes out of the door assembly through the front discharge outlet to discharge cooled air to the indoor space, thereby preventing few formation on a surface of the door assembly.

Sixth, according to the present disclosure, there is an advantage in that the fan housing is inserted into the door assembly in the projection state to minimize leakage of the air in the fan housing, into the cabinet assembly.

Seventh, according to the present disclosure, there is an advantage in that a suction inlet is provided on a rear surface of the cabinet assembly and a heat exchange assembly is disposed in front of the suction inlet to linearly move the air forward, which is suctioned from the rear thereof, thereby minimizing the air flow resistance.

Eighth, according to the present disclosure, there is an advantage in that the guide housing contacts the front surface of the heat exchange assembly to flow the conditioned air into the fan housing assembly through the guide housing suction inlet provided in the guide housing.

Ninth, according to the present disclosure, there is an advantage in that it is expanded or contracted based on the forward movement or a rearward movement of the fan housing assembly when an air guide is coupled to the fan housing assembly, to provide the fan housing assembly with the independent flow path.

Tenth, according to the present disclosure, there is an advantage in that the fan housing assembly is moved forward or rearward along a central axis (C1) connecting a center of the guide housing suction inlet and a center of the front discharge outlet to prevent a phenomenon in which the fan housing assembly is engaged with the door assembly and is not inserted into the front discharge outlet, when the fan housing assembly is moved forward.

Eleventh, according to the present disclosure, there is an advantage in that the first guide rail and the second guide rail are disposed bilaterally symmetrical with each other with respect to the central axis (C1) to laterally balance them when the fan housing assembly is moved forward or rearward and prevent occurrence of eccentricity at either side thereof during movement.

Twelfth, according to the present disclosure, there is an advantage in that the first rack and the second rack are disposed bilaterally symmetrical with each other with respect to the central axis (C1) to laterally balance them when the fan housing assembly is moved forward or rearward and prevent occurrence of eccentricity at either side thereof during movement.

Thirteenth, according to the present disclosure, there is an advantage in that, as the steering grill protrudes out of the door assembly through the front discharge outlet, the cooled air discharged by the steering grill passes through the door assembly and is discharged to the indoor space, thereby preventing dew formation on a surface of the door assembly.

DETAILED DESCRIPTION

Figure 1:
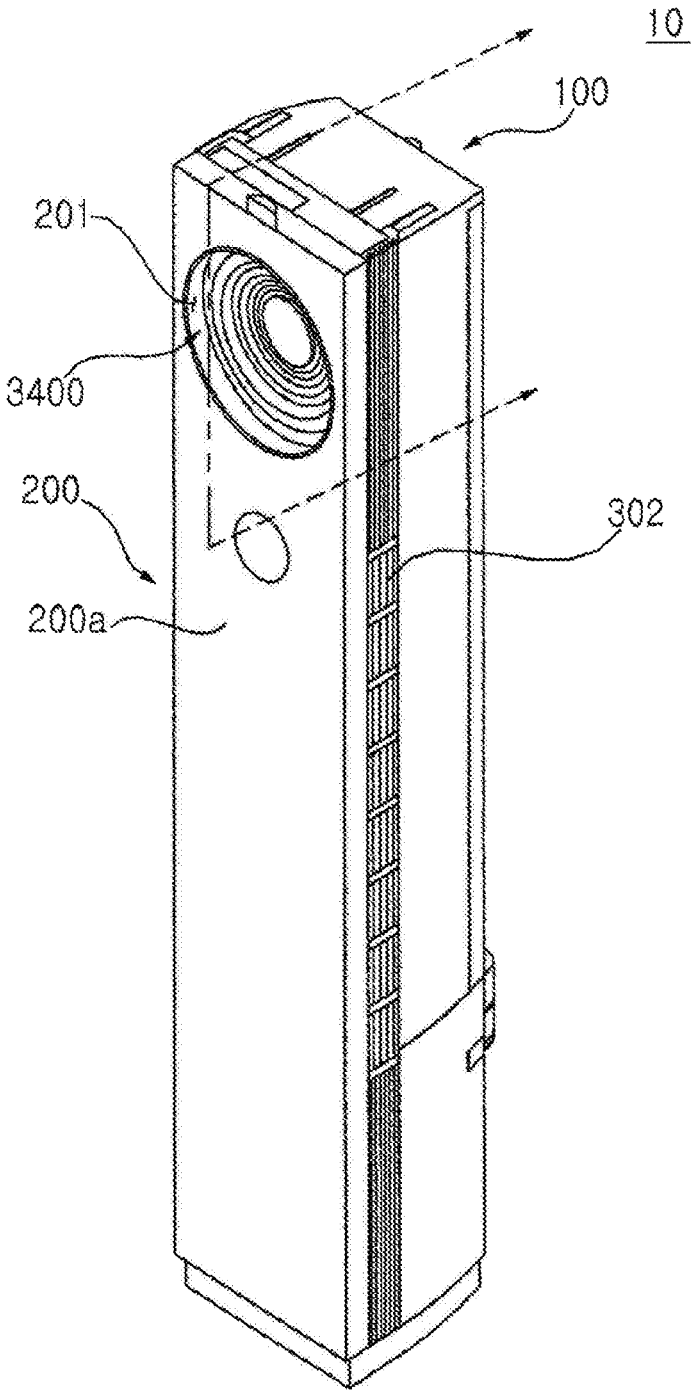
FIG. 1 is a perspective view showing an indoor unit of an air conditioner according to an embodiment of the present disclosure.

Advantages, features, and methods for achieving the foregoing will be clarified with reference to embodiments described below in detail together with the accompanying drawings. Exemplary embodiments may, however, be embodied in different manners and should not be construed as being limited to the exemplary embodiments set forth herein. Rather, these exemplary embodiments are provided so that this disclosure will be thorough and complete, and will fully convey the scope of exemplary embodiments to those skilled in the art. Same reference numerals may be used throughout the present disclosure to designate the same or similar components.

Hereinafter, the present disclosure will be described in detail with reference to the accompanying drawings.

Figure 2:
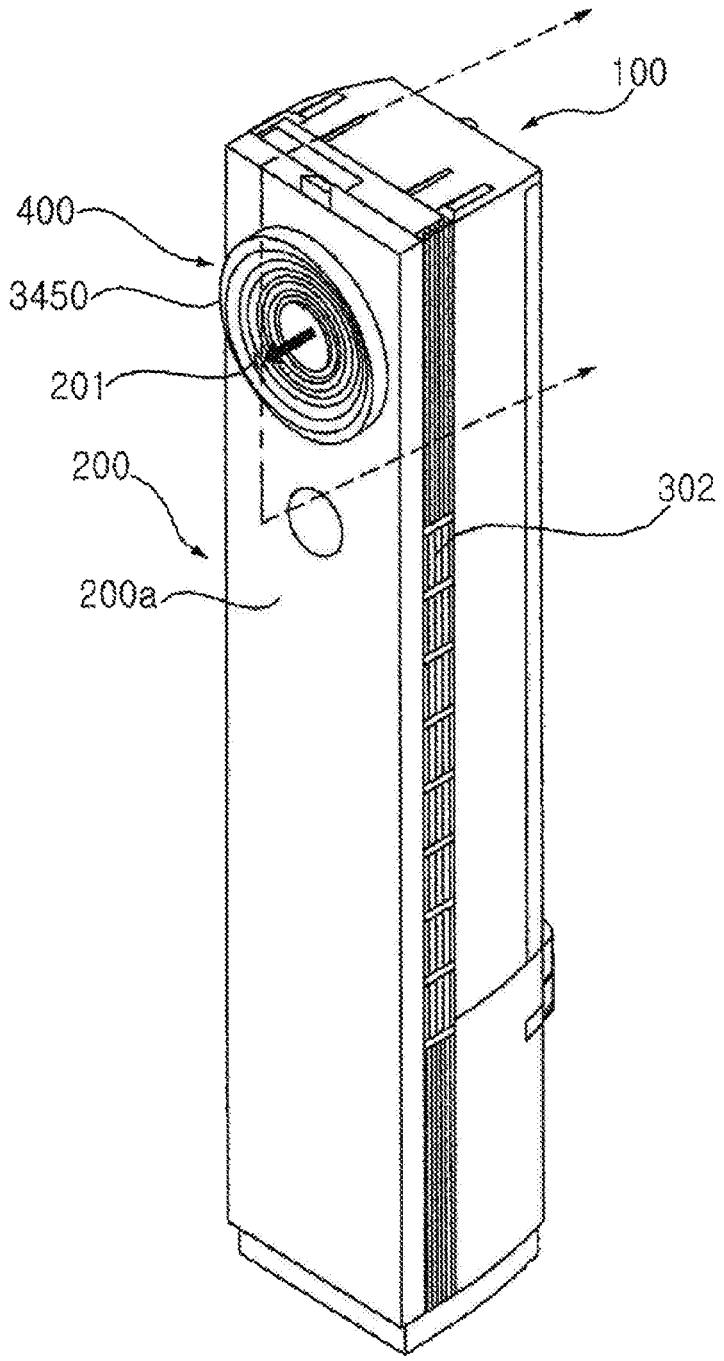
FIG. 2 is an exemplary view showing a long-distance fan assembly in FIG. 1 moving forward.

FIG. 1 is a perspective view showing an indoor unit of an air conditioner according to an embodiment of the present disclosure. FIG. 2 is an exemplary view showing a long-distance fan assembly in FIG. 1 moving forward.

According to this embodiment, the air conditioner includes an indoor unit 10 and an outdoor unit (not shown) connected to the indoor unit 10 through a refrigerant pipe which circulates refrigerant.

The outdoor unit includes a compressor (not shown) to compress the refrigerant, an outdoor heat exchanger (not shown) to receive the refrigerant from the compressor and condense the refrigerant, an outdoor fan (not shown) to supply air to the outdoor heat exchanger, and an accumulator (not shown) to receive the refrigerant discharged by the indoor unit 10 and provide gas refrigerant to the compressor.

The outdoor unit may further include a four-way valve (not shown) to operate the indoor unit in a cooling mode or a heating mode. When the air conditioner is operated in the cooling mode, the indoor unit 10 evaporates the refrigerant and cools the indoor air. When the air conditioner is operated in the heating mode, the indoor unit 10 condenses the refrigerant to heat the indoor air.

<<<Configuration of Indoor Unit>>>

The indoor unit includes a cabinet assembly 100 to define an opening at a front surface thereof, a suction inlet 101 at a rear surface thereof, and an inner space (S), a door assembly 200 assembled to the cabinet assembly 100, to define a front discharge outlet 201, cover a front surface of the cabinet assembly 100, and open and close a front surface of the cabinet assembly 100, fan assemblies 300 and 400 disposed in the cabinet assembly 100 and to discharge air in the inner space (S) to an indoor space, a heat exchange assembly 500 disposed between the fan assembly 300, 400 and the cabinet assembly 100 and to heat-exchange the suctioned indoor air with the refrigerant, and a filter assembly 600 disposed at a rear surface of the cabinet assembly 100 and to filter air flowing through the suction inlet 101.

The indoor unit includes the suction inlet 101 disposed on the rear surface of the cabinet assembly 100, a side discharge outlet 302 disposed at a side surface of the cabinet assembly 100, and a front discharge outlet 201 disposed on a front surface of the door assembly 200.

The air suctioned through the suction inlet 101 is discharged into the indoor space through the front discharge outlet 201 or the side discharge outlet 302.

The suction inlet 101 is disposed on the rear surface of the cabinet assembly 100.

The side discharge outlets 302 are disposed on the left side and the right side of the cabinet assembly 100.

The front discharge outlet 201 is disposed in the door assembly 200. The front discharge outlet 201 penetrates the door assembly 200.

When viewed from the front, the front discharge outlet 201 is disposed at an upper portion of the door assembly 200 to flow the air discharged from the front discharge outlet 201 to a remote indoor space. The front discharge outlet 201 is preferably disposed above the middle of the door assembly 200.

In this embodiment, the fan assemblies 300 and 400 include a short-distance fan assembly 300 and a long-distance fan assembly 400. In contrast to this embodiment, the short-distance fan assembly 300 may be omitted and only the long-distance fan assembly 400 may be disposed. When the short-distance fan assembly 300 is omitted, the side discharge outlet 302 is also omitted and the conditioned air may only be discharged to the front discharge outlet 201.

The short-distance fan assembly 300 and the long-distance fan assembly 400 are each disposed in front of the heat exchange assembly 500. In addition, the short-distance fan assembly 300 and the long-distance fan assembly 400 are each disposed in front of the filter assembly 600. In this embodiment, the heat exchange assembly 500 is disposed in front of the filter assembly 600 and the fan assemblies 300 and 400 are each disposed in front of the heat exchange assembly 500.

The air is introduced into the short-distance fan assembly 300 and the long-distance fan assembly 400 through the heat exchange assembly 500. In this case, the air is conditioned while passing through the heat exchange assembly 500 and the conditioned air is introduced into the short-distance fan assembly 300 and the long-distance fan assembly 400.

The heat exchange assembly 500 is disposed inside the cabinet assembly 100, is disposed in front of the suction inlet 101, and may cover the entire suction inlet 101.

The suction inlet 101 is disposed on the rear surface of the cabinet assembly 100 and is disposed vertically. The heat exchange assembly 500 covers the entire suction inlet 101 to pass the air suctioned to the suction inlet 101 through the heat exchange assembly 500.

The heat exchange assembly 500 faces the suction inlet 101 and the rear surface of the cabinet assembly 100 and is disposed vertically.

The heat exchange assembly 500 may be vertically disposed to minimize an installation space of the heat exchange assembly 500 and contact the short-distance fan assembly 300 and the long-distance fan assembly 400 with the front surface of the heat exchange assembly 500.

The short-distance fan assembly 300 and the long-distance fan assembly 400 each contact the front surface of the heat exchange assembly 500 to effectively minimize the inner space of the cabinet assembly 100.

In particular, the filter assembly 600, the heat exchange assembly 500, and the fan assemblies 300, 400 are all vertically disposed and sequentially stacked from a rear side to a front side thereof to minimize a thickness in a forward and rearward direction of the indoor unit.

When the heat exchange assembly 500 is disposed inside the cabinet assembly 100, the heat exchange assembly 500 is inclined forward and rearward to occupy more installation space than the heat exchange assembly 500 that is vertically disposed, which causes an increase in thickness in the forward and rearward direction of the indoor unit.

The short-distance fan assembly 300 and the long-distance fan assembly 400 are each manufactured to have a length corresponding to a height of the heat exchange assembly 500.

The short-distance fan assembly 300 and the long-distance fan assembly 400 may each be vertically stacked. In this embodiment, the long-distance fan assembly 400 is disposed above the short-distance fan assembly 300. As the long-distance fan assembly 400 is disposed above the short-distance fan assembly 300, the discharge air discharged from the long-distance fan assembly 400 may flow to a remote place in the indoor space.

The short-distance fan assembly 300 discharges air laterally with respect to the cabinet assembly 100. The short-distance fan assembly 300 may provide an indirect air flow to a user. The short-distance fan assembly 300 simultaneously discharges air to the left side and the right side of the cabinet assembly 100.

The long-distance fan assembly 400 is disposed above the short-distance fan assembly 300 and is disposed in the cabinet assembly 100 at an upper portion thereof.

The long-distance fan assembly 400 discharges air through the front discharge outlet 201 disposed in the cabinet assembly 100. The long-distance fan assembly 400 provides a direct air flow to the user.

The long-distance fan assembly 400 discharges the air to a remote place. If the long-distance fan assembly 400 only functions to supply the air to a remote place in the indoor space, the long-distance fan assembly 400 may be disposed on the upper portion of the indoor unit.

According to this embodiment, the long-distance fan assembly 400 may provide the direct air flow to an indoor target area. The target area may be an area having a large deviation between a target temperature and a room temperature. The target area may be an area where a user or a pet is located.

The long-distance fan assembly 400 includes a direction-adjustable steering grill 3450 to supply the direct air flow to the target area.

In this embodiment, the long-distance fan assembly 400 protrudes from the cabinet assembly 100 during operation and is concealed in the cabinet assembly 100 when not in operation.

When the long-distance fan assembly 400 is operated, the long-distance fan assembly 400 passes through the front discharge outlet 201 of the door assembly 200 and protrudes forward from the door assembly 200.

The long-distance fan assembly 400 protrudes from the front discharge outlet 201 to minimize interference of the direct air flow with the door assembly 200. When the long-distance fan assembly 400 is disposed inside the cabinet assembly 100 to discharge the air, air resistance is generated during passing the air through the front discharge outlet 201.

In this embodiment, when the long-distance fan assembly 400 provides a direct air flow to the indoor space, the steering grill 3450 of an exemplary component of the long-distance fan assembly 400 penetrates the front discharge outlet 201 and protrudes further forward than the cabinet assembly 100.

Only the exemplary component of the long-distance fan assembly 400 (e.g., the steering grill in this embodiment) penetrates the door assembly 200 to minimize a moving distance of the long-distance fan assembly 400 and obtain desired effects.

In particular, the long-distance fan assembly 400 may adjust an angle of the steering grill 3450 protruding out of the front discharge outlet 201. A direction of the steering grill 3450 is not limited to a specific angle or direction.

The steering grill 3450 may be disposed upward, downward, leftward, rightward, or diagonally with respect to the front surface of the cabinet assembly 100 when the steering grill 3450 protrudes from the front discharge outlet 201.

In addition, in this embodiment, the long-distance fan assembly 400 may immediately change the direction of the steering grill 3450 from a first specific direction to a second specific direction.

Referring to FIG. 2, the long-distance fan assembly 400 may protrude forward from the door assembly 200 through the front discharge outlet 201. In particular, the steering grill 3450 protrudes further forward than a front surface 200*a* of the door assembly 200.

A state in which the steering grill 3450 protrudes further forward than the door assembly 200 is referred to as "a projection state".

When the steering grill 3450 is in the projection state, the steering grill 3450 may entirely protrude from the front surface of the door assembly 200. In this embodiment, the front surface of the steering grill 3450 partially protrudes forward from the front surface 200*a* of the door assembly 200.

Referring to FIGS. 3 to 8, the steering grill 3450 may be tilted in any direction in the projection state. When viewed from the front of the cabinet assembly 100, the steering grill 3450 is tiltable upward, downward, leftward, rightward, or diagonally.

In the projection state, the steering grill 3450 may be tilted in any direction to provide direct air flow to the indoor target area.

Hereinafter, components of the indoor unit according to this embodiment are described in more detail.

<<Configuration of Short-Distance Fan Assembly>>

The short-distance fan assembly 300 discharges air to a side discharge outlet 302 of the cabinet assembly 100. The short-distance fan assembly 300 discharges the air to the side discharge outlet 302 and provides indirect air flow to a user.

The short-distance fan assembly 300 is disposed in front of the heat exchange assembly 500. The short-distance fan assembly 300 includes a plurality of fans 310 vertically stacked. In this embodiment, the short-distance fan assembly 300 includes three fans 310 vertically stacked.

In this embodiment, the fan 310 uses a centrifugal mixed flow fan. The fan 310 suctions air in an axial direction and discharges the air in a circumferential direction.

The fan 310 suctions the air from the rear side thereof, discharges the air in the circumferential direction thereof, and the air discharged in the circumferential direction flows to the front side thereof.

The short-distance fan assembly 300 includes a fan casing 320 defining openings at a front side and a rear side thereof and coupled to the cabinet assembly 100 and a plurality of fans 310 coupled to the fan casing 320 and disposed in the fan casing 320.

The fan casing 320 has a box shape and defines openings at a front surface and a rear surface thereof. The fan casing 320 is coupled to the cabinet assembly 100.

The front surface of the fan casing 320 faces the door assembly 200. The rear surface of the fan casing 320 faces the heat exchange assembly 500.

The front surface of the fan casing 320 contacts the door assembly 200 and is closed.

In this embodiment, a portion of the side surface of the fan casing 320 is exposed to an outside. The fan casing 320 exposed to the outside defines a side discharge outlet 302. A discharge vane is disposed in the side discharge outlet 302 to control an air discharge direction. The side discharge outlets 302 are disposed on the left side and the right side of the fan casing 320.

The fan 310 is disposed inside the fan casing 320. The plurality of fans 310 are disposed on the same plane and are vertically stacked in a row.

The fan 310 uses the centrifugal mixed flow fan to suction the air from the rear surface of the fan casing 320 and then discharge the air forward in the circumferential direction.

Figure 3:
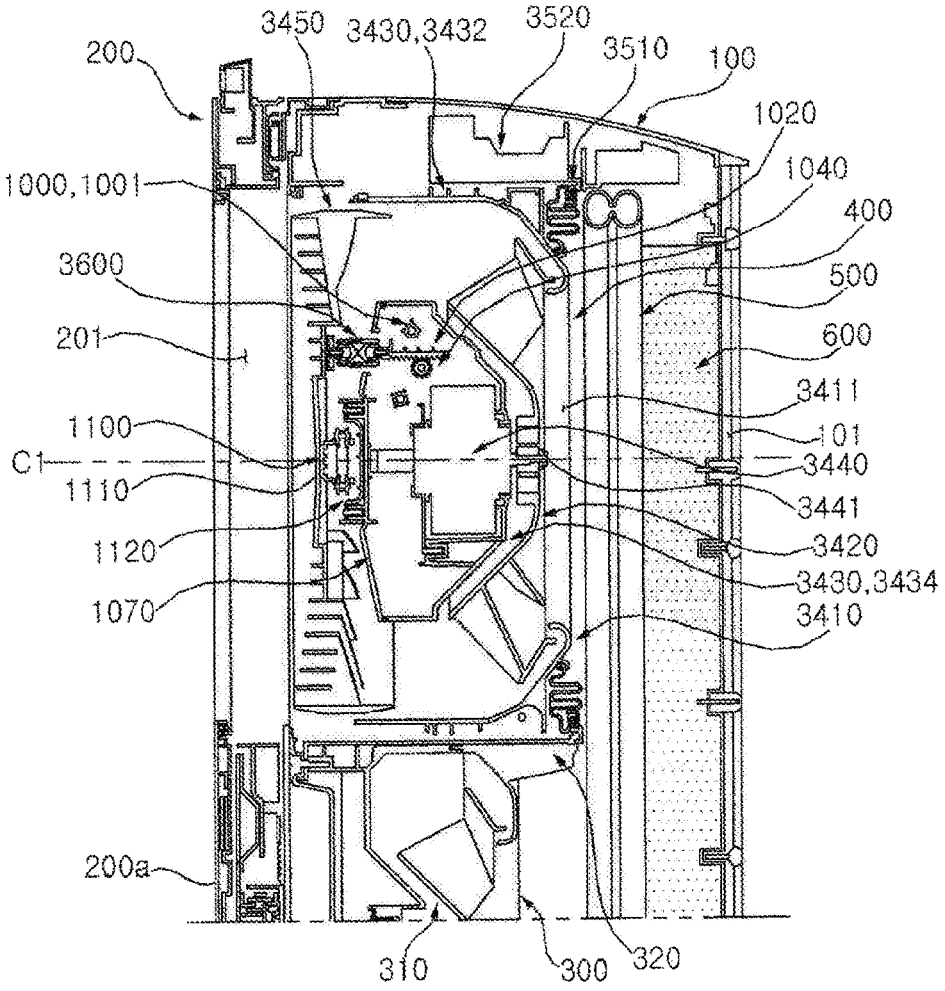
FIG. 3 is a cross-sectional view showing a long-distance fan assembly in FIG. 1.
Figure 4:
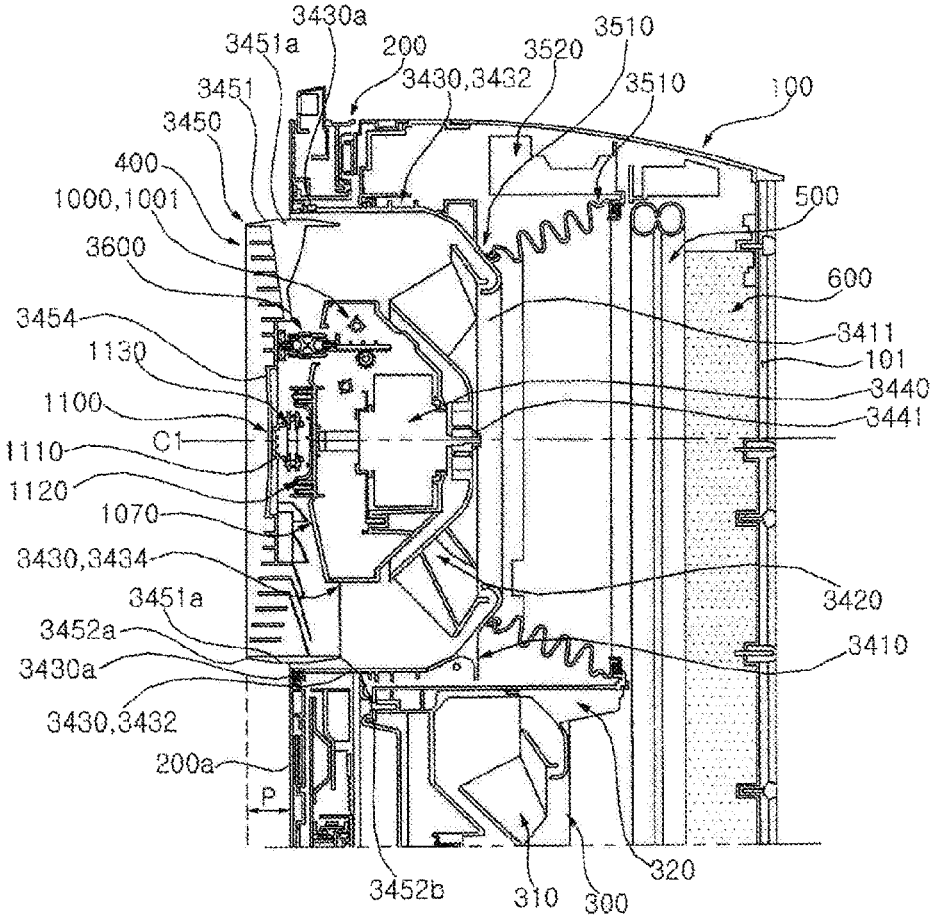
FIG. 4 is a cross-sectional view showing the long-distance fan assembly in FIG. 2.
Figure 5:
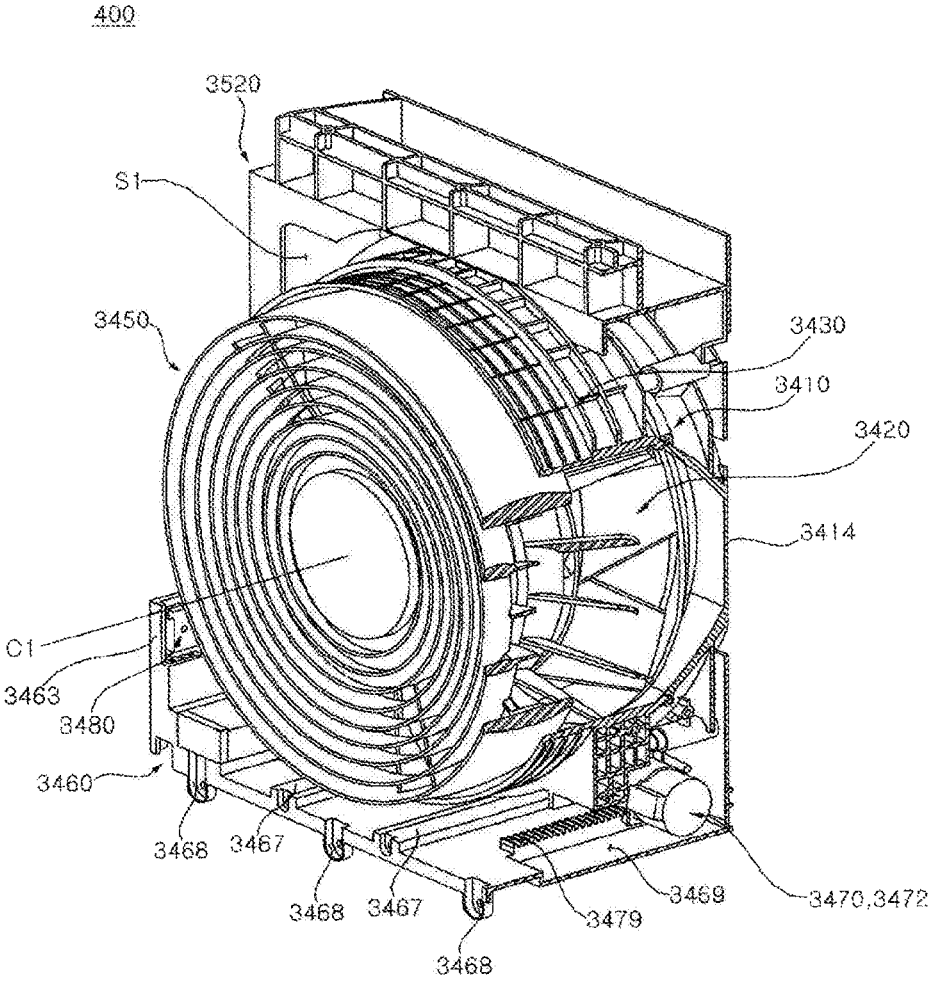
FIG. 5 is a partially cut-away perspective view showing a long-distance fan assembly according to an embodiment of the present disclosure.
Figure 6:
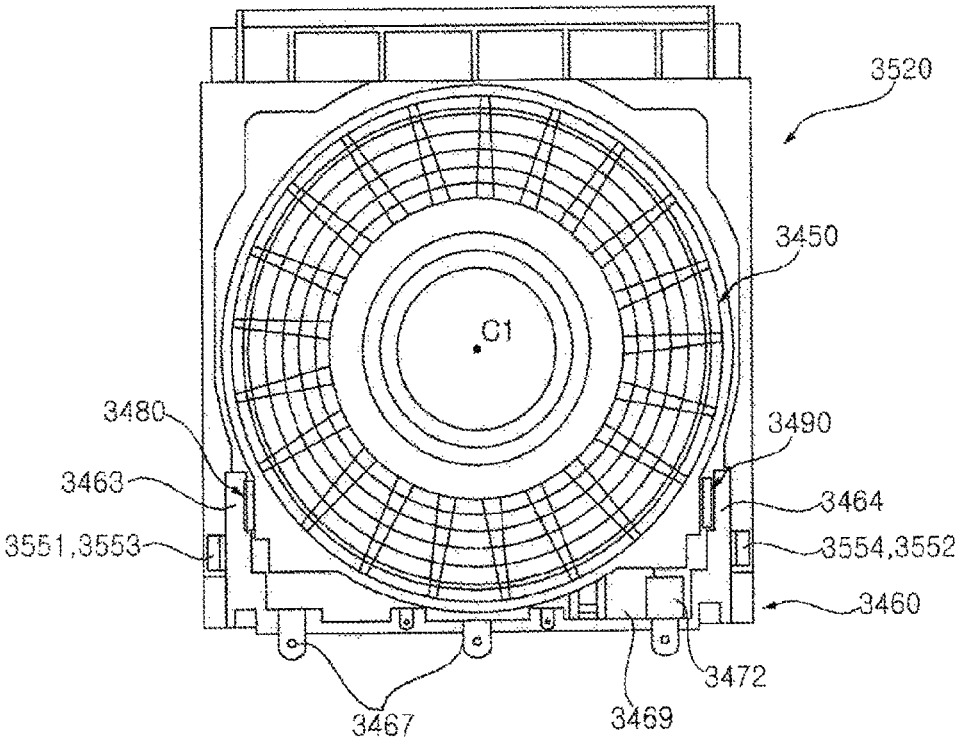
FIG. 6 is a front view showing a long-distance fan assembly according to an embodiment of the present disclosure.
Figure 7:
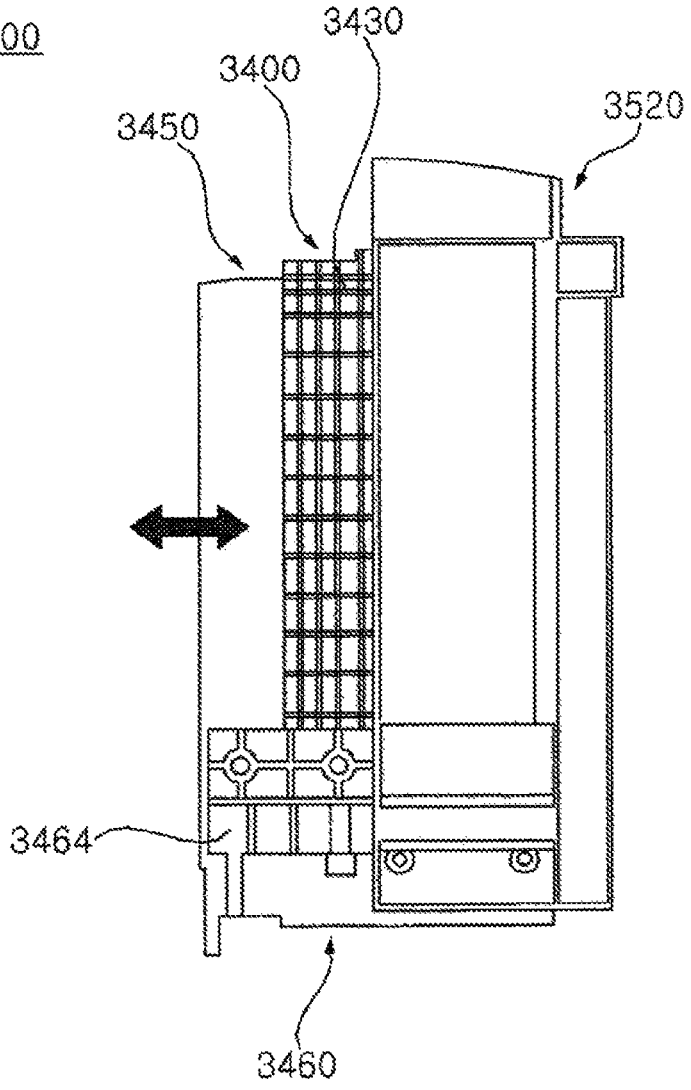
FIG. 7 is a right side view showing the long-distance fan assembly in FIG. 5.
Figure 8:
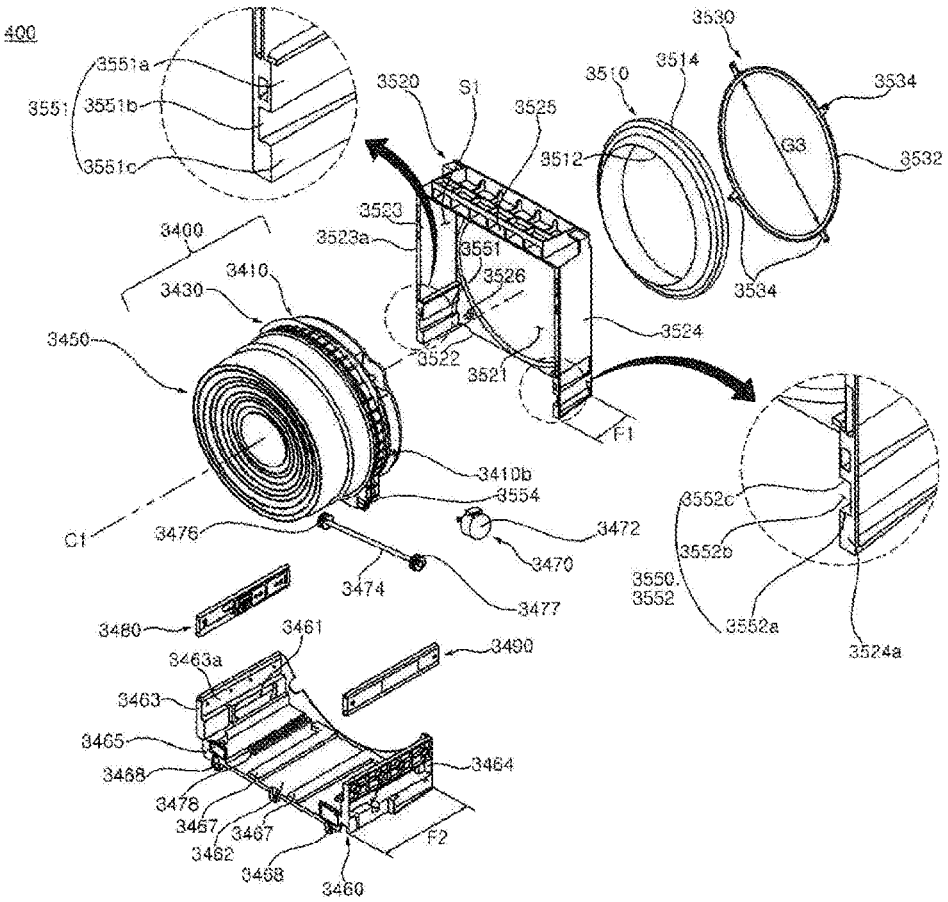
FIG. 8 is an exploded perspective view showing the long-distance fan assembly in FIG. 6.
Figure 9:
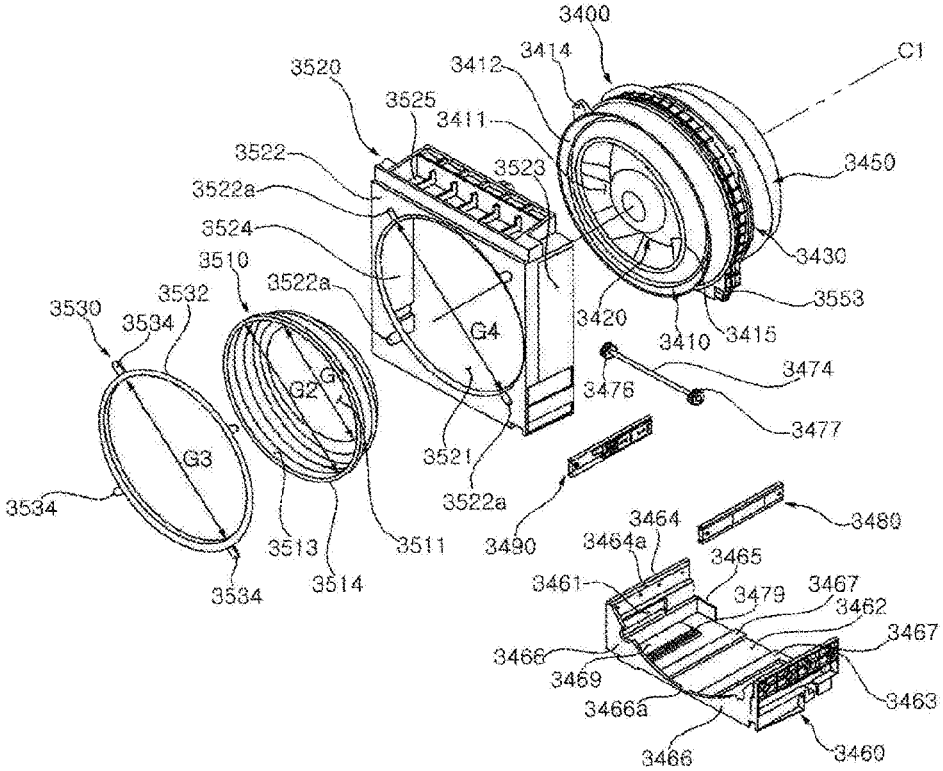
FIG. 9 is an exploded perspective view showing the long-distance fan assembly in FIG. 8 viewed from the rear.
Figure 10:
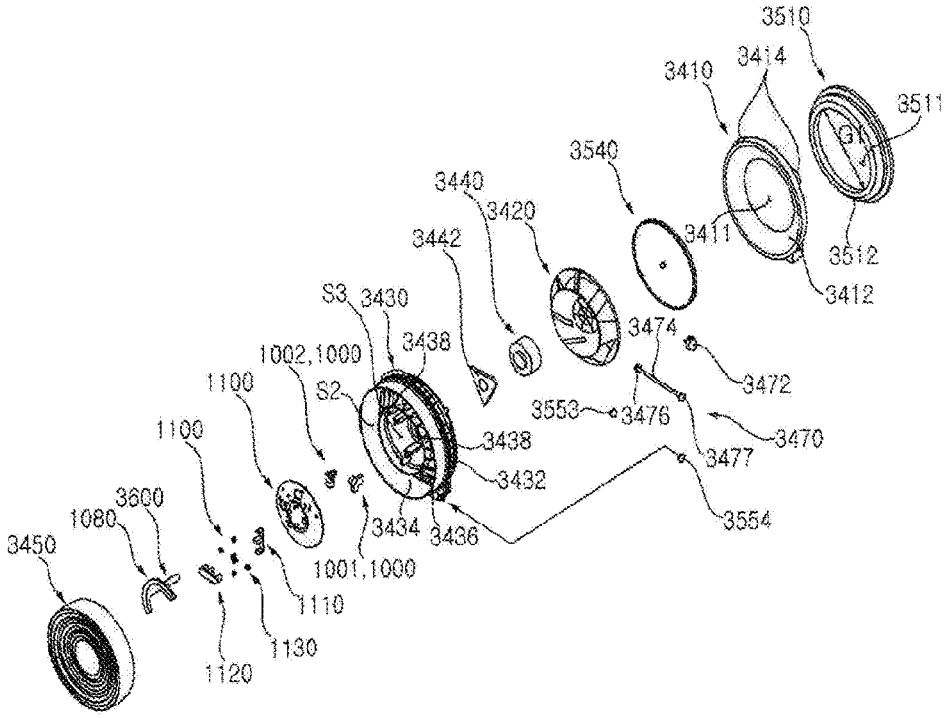
FIG. 10 is an exploded perspective view showing a fan housing assembly in FIG. 8.
Figure 11:
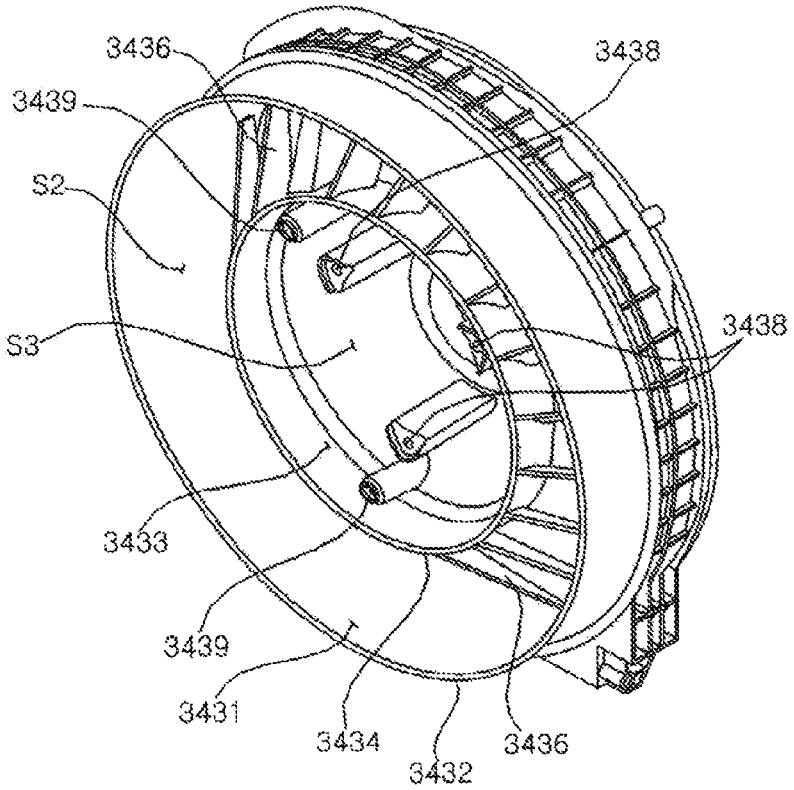
FIG. 11 is a perspective view showing a front fan housing in FIG. 10.
Figure 12:
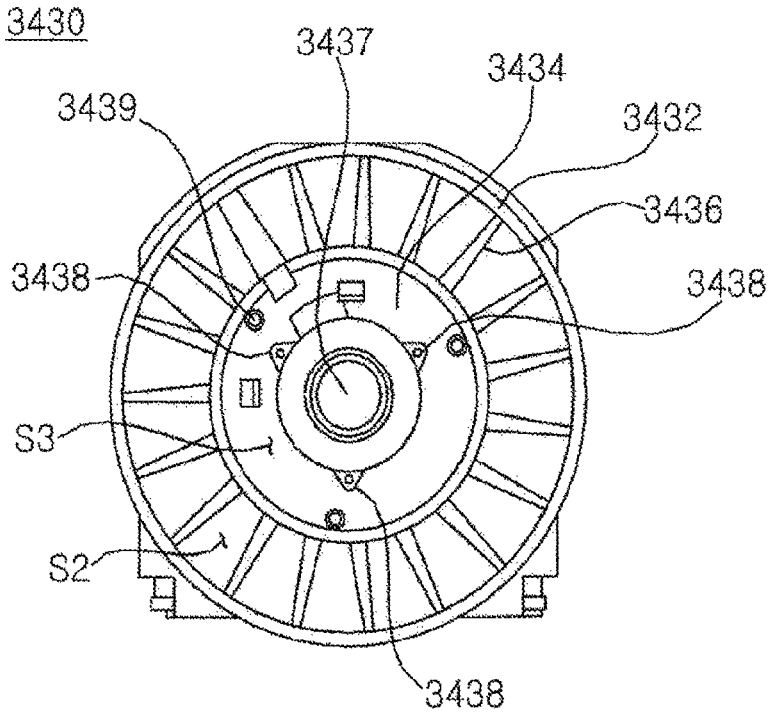
FIG. 12 is a front view showing the front fan housing in FIG. 11.
Figure 13:
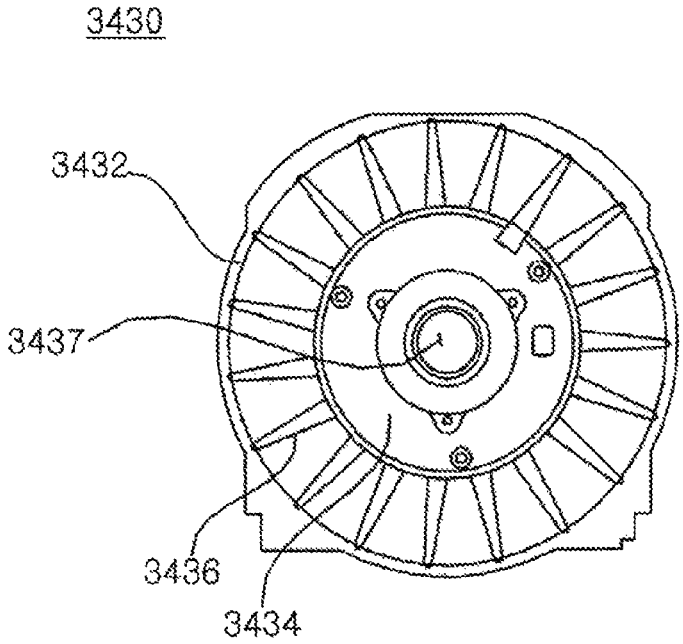
FIG. 13 is a rear view showing the front fan housing in FIG. 11.
Figure 14:
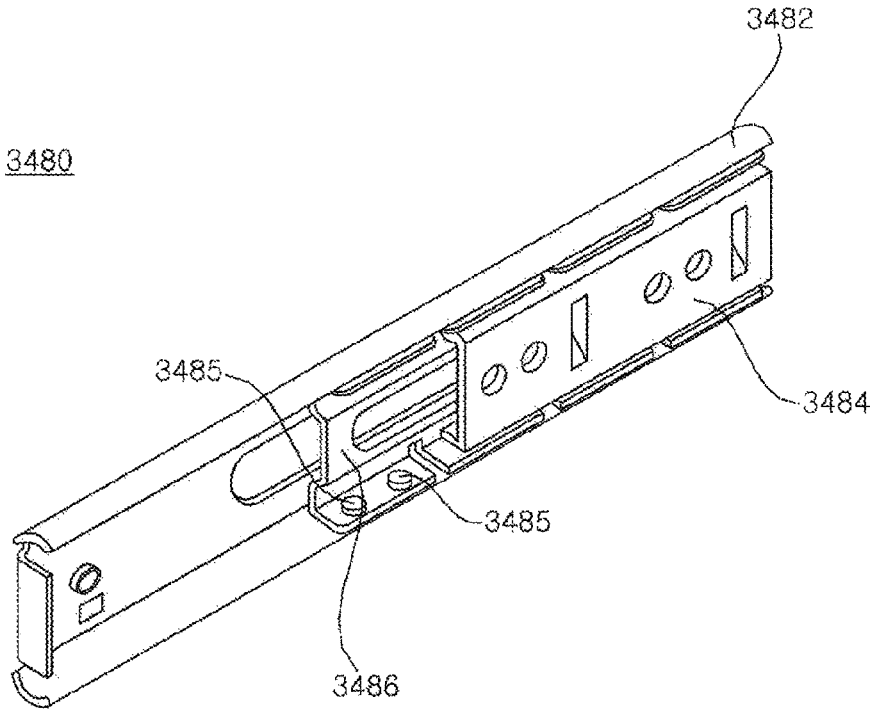
FIG. 14 is a perspective view showing a guide rail in FIG. 8.
Figure 15:
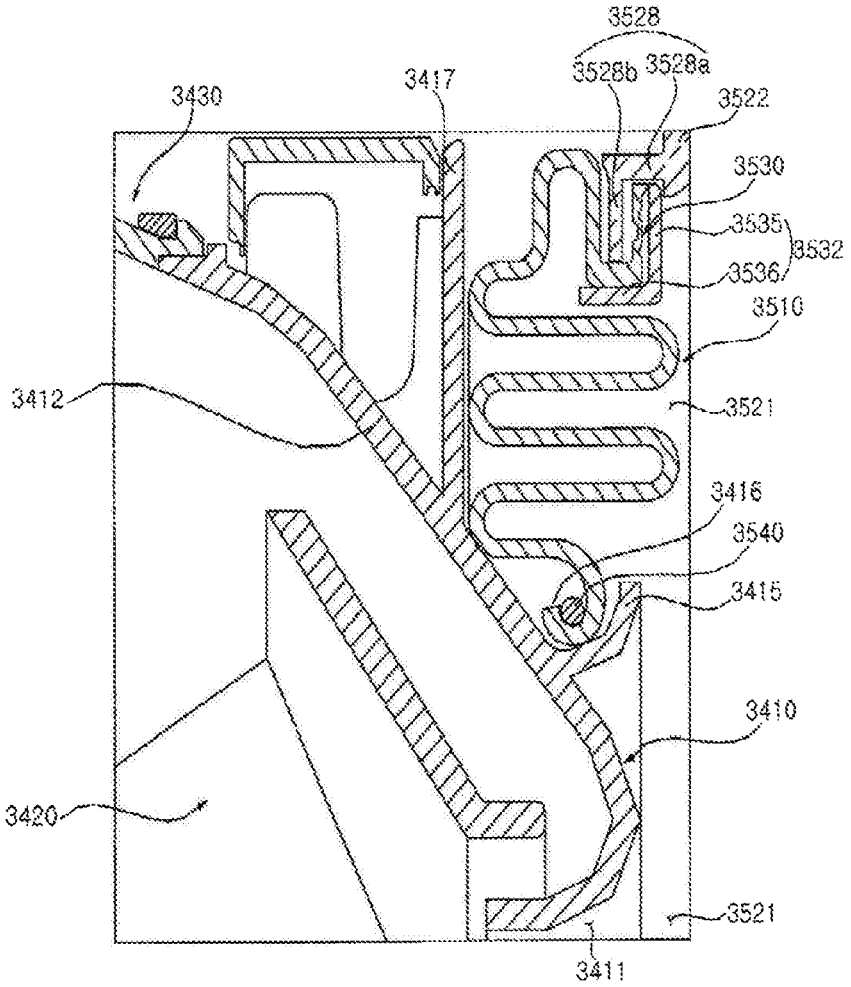
FIG. 15 is a cross-sectional view showing an air guide in FIG. 8 before operation.

FIG. 3 is a cross-sectional view showing a long-distance fan assembly in FIG. 1. FIG. 4 is a cross-sectional view showing the long-distance fan assembly in FIG. 2 moving forward. FIG. 5 is a partially cut-away perspective view showing a long-distance fan assembly according to an embodiment of the present disclosure. FIG. 6 is a front view showing a long-distance fan assembly according to an embodiment of the present disclosure. FIG. 7 is a right side view showing the long-distance fan assembly in FIG. 5. FIG. 8 is an exploded perspective view showing the long-distance fan assembly in FIG. 6. FIG. 9 is an exploded perspective view showing the long-distance fan assembly in FIG. 8 viewed from the rear. FIG. 10 is an exploded perspective view showing a fan housing assembly in FIG. 8. FIG. 11 is a perspective view showing a front fan housing in FIG. 10. FIG. 12 is a front view showing the front fan housing in FIG. 11. FIG. 13 is a rear view showing the front fan housing in FIG. 11. FIG. 14 is a perspective view showing a guide rail in FIG. 8. FIG. 15 is a cross-sectional view showing an air guide in FIG. 8 before operation.

<<Configuration of Long-Distance Fan Assembly>>

The long-distance fan assembly 400 is movable relative to the cabinet assembly 100 in a forward and rearward direction. The long-distance fan assembly 400 discharges air through a front of the door assembly 200 and provides direct air flow to an indoor space.

The long-distance fan assembly 400 passes through a front discharge outlet 201 of the door assembly 200 during operation and protrudes forward from a front surface 200*a* of the door assembly 200. Here, the long-distance fan assembly 400 is in a projection state.

The long-distance fan assembly 400 is disposed inside the cabinet assembly 100 and is moved in the forward and rearward direction inside the cabinet assembly 100 during operation.

The long-distance fan assembly 400 is disposed in front of the heat exchange assembly 500 and is disposed behind the door assembly 200. The long-distance fan assembly 400 is disposed above the short-distance fan assembly 300 and is disposed below an upper wall of the cabinet assembly 100.

The long-distance fan assembly 400 discharges air through the front discharge outlet 201 defined in the door assembly 200 and the steering grill 3450 of the long-distance fan assembly 400 is disposed in front of the front discharge outlet 201.

The steering grill 3450 is disposed outside the front discharge outlet 201 to minimize air resistance due to structures such as the cabinet assembly 100 or the door assembly 200.

The long-distance fan assembly 400 provides a structure tiltable in an upward direction, a downward direction, a leftward direction, a rightward direction, or a diagonal direction. The long-distance fan assembly 400 may discharge the air to a remote place of the indoor space and may improve indoor air circulation.

The long-distance fan assembly 400 includes a guide housing (e.g., in this embodiment, an upper guide housing and a lower guide housing described below) disposed inside the cabinet assembly, a fan housing assembly 3400 assembled to be movable relative to the guide housing and to discharge air in the inner space (S) to the front discharge outlet, and an actuator 3470 disposed in at least one of the cabinet assembly 100 or the guide housing and to move the fan housing assembly along the guide housing.

The guide housing includes an upper guide housing 3520 disposed in front of the heat exchange assembly 500 and defining a guide housing suction inlet 3521 to introduce air passing through the heat exchange assembly 500 and a lower guide housing 3460 assembled to the upper guide housing 3520 and to place the front fan housing 3430, and to guide forward and rearward movement of the front fan housing 3430.

The fan housing assembly 3400 includes a rear fan housing 3410 defining a fan suction inlet 3411 communicating with the guide housing suction inlet 3521 and disposed in the upper guide housing 3520, a fan 3420 disposed in front of the rear fan housing 3410 and to discharge air suctioned by the fan suction inlet 3411 in a diagonal direction, a front fan housing 3430 disposed in front of the rear fan housing 3410, coupled to the rear fan housing 3410, disposed in front of the fan 3420, assembled to the fan 3420, and to guide air pressurized by the fan 3420 in the diagonal direction, a fan motor 3440 disposed in front of the front fan housing 3430, including a motor shaft 3441 assembled to the fan 3420 through the front fan housing 3430, and to rotate the fan 3420, a steering grill 3450 disposed in front of each of the front fan housing 3430 and the fan motor 3440, tiltable in any direction with respect to the front fan housing 3430, and to control a discharge direction of air guided by the front fan housing 3430, and a steering assembly 1000 disposed between the front fan housing 3430 and the steering grill 3450 and configured to push or pull the steering grill 3450 to tilt the steering grill 3450 with respect to a central axis (C1) of the steering grill 3450.

The actuator 3470 is disposed in at least one of the front fan housing 3430 or the lower guide housing 3460 and provides a driving force when the front fan housing 3430 moves in the forward and rearward direction.

The long-distance fan assembly 400 further includes an air guide 3510 opened in the forward and rearward direction, connecting the rear fan housing 3410 to the upper guide housing 3520, to guide the air suctioned by the guide housing suction inlet 3521 into the fan suction inlet 3411, made of an elastic material, and to expand or contract when the front fan housing 3430 moves in the forward and rearward direction.

For convenience of description, the assembly moved in the forward and rearward direction by an actuator 3470 of the long-distance fan assembly 400 is referred to as "a fan housing assembly 3400". The fan housing assembly 3400 includes a rear fan housing 3410, a front fan housing 3430, a fan 3420, a steering grill 3450, a fan motor 3440, and a steering assembly 1000.

The fan housing assembly 3400 may be moved in the forward and rearward direction by the actuator 3470. A first guide rail 3480 and a second guide rail 3490 may be further disposed between the front fan housing 3430 and the lower guide housing 3460 to easily slide the front fan housing 3430.

The lower guide housing 3460 and the upper guide housing 3520 are coupled structures and each may be coupled to at least one of the cabinet assembly 100 or the short-distance fan assembly 300.

The air that has passed through the heat exchange assembly 500 passes through the guide housing suction inlet 3521, the fan suction inlet 3411, the fan 3420, and the front fan housing 3430, and is discharged from the steering grill 3450.

The upper guide housing 3520 and the lower guide housing 3460 may be integrated with each other. The integrated upper guide housing 3520 and lower guide housing 3460 may be referred to as "a guide housing".

The guide housing defines an opening at a front surface thereof to move the fan housing assembly 3400 in the forward and rearward direction and defines a guide housing suction inlet 3521 at a rear surface thereof to suction the air.

In this embodiment, the upper guide housing 3520 and the lower guide housing 3460 are respectively fabricated and assembled to move the fan housing assembly 3400 in the forward and rearward direction.

<Configuration of Upper Guide Housing>

The upper guide housing 3520 constitutes an upper portion of the guide housing. The upper guide housing 3520 surrounds the fan housing assembly 3400. The upper guide housing 3520 guides air that has passed through the heat exchange assembly 500 to the fan housing assembly 3400.

The upper guide housing 3520 prevents air passing through the heat exchange assembly 500 from flowing into the steering grill 3450 through other flow paths except for the guide housing suction inlet 3521.

The guide housing suction inlet 3521 provides a unified flow path for guiding the cooled air to the steering grill 3450 to minimize contact of the cooled air with the door assembly 200.

The upper guide housing 3520 preferably has an area capable of covering the front surface of the heat exchange assembly 500. In this embodiment, as the short-distance fan assembly 300 is disposed, the upper guide housing 3520 has a shape and an area to cover the upper remaining area not covered by the short-distance fan assembly 300.

The upper guide housing 3520 is assembled to the lower guide housing 3460 and is disposed on the lower guide housing 3460. The upper guide housing 3520 and the lower guide housing 3460 are integrated with each other through fastening.

The fan housing assembly is disposed inside each of the upper guide housing 3520 and the lower guide housing 3460 and is movable relative to each of the upper guide housing 3520 and the lower guide housing 3460 in the forward and rearward direction.

The upper guide housing 3520 has a rectangular parallelepiped shape and defines openings at the front surface and the rear surface thereof.

The upper guide housing 3520 includes a rear wall 3522 defining a guide housing suction inlet 3521, a left wall 3523 and a right wall 3524 protruding forward from a side edge of the rear wall 3522, and a top wall 3525 protruding forward from an upper edge of the rear wall 3522.

The guide housing suction inlet 3521 penetrates the rear wall 3522 in the forward and rearward direction. The guide housing suction inlet 3521 has a circular shape when viewed from the front. The guide housing suction inlet 3521 is larger than the fan suction inlet 3411. The fan suction inlet 3411 also has a circular shape when viewed from the front. The diameter of the guide housing suction inlet 3521 is greater than the diameter of the fan suction inlet 3411.

The left wall 3523 is disposed on the left when viewed from the front and the right wall 3524 is disposed on the right. The left wall 3523 and the right wall 3524 face each other.

The top wall 3525 connects the rear wall 2522, the left wall 3523, and the right wall 3524. The fan housing assembly is disposed under the top wall 3525.

When not in operation, the fan housing assembly is disposed between the left wall 3523, the right wall 3524, and the top wall 3525. In operation, the fan housing assembly is moved forward.

Even when the fan housing assembly is moved forward to its maximum extent, the rear fan housing 3410 is disposed inside the upper guide housing 3520. In this embodiment, when the fan housing assembly is moved forward to its maximum extent, a rear end 3410*b* of the rear fan housing 3410 is disposed at a rear side than each of a front end 3523*a* of the left wall 3523 and a front end 3524*a* of the right wall 3524.

When the fan housing assembly moves out of the upper guide housing 3520 during operation to return to an initial position thereof, if an external shock is applied, the fan housing assembly may engage with the upper guide housing 3520 and may not return to the initial position thereof.

Further, when the fan housing assembly moves out of the upper guide housing 3520, a flow distance of air flowing from the guide housing suction inlet 3521 to the fan suction inlet 3411 may be increased.

A fixer 3526 is disposed in the rear wall 3522 to fix the air guide 3510. The fixer 3526 protrudes forward from the front surface of the rear wall 3522. A plurality of fixers 3526 are disposed and each fixer 3526 is disposed outside the guide housing suction inlet 3521. In this embodiment, the fixers 3526 are disposed in four places.

In this embodiment, a lower surface 3527 of the upper guide housing 3520 is opened. In contrast to this embodiment, the lower surface 3527 may be closed.

In this embodiment, as the lower guide housing 3460 is disposed under the upper guide housing 3520 and the lower guide housing 3460 closes the lower surface 3527, the lower surface 3527 may be manufactured to have an open shape.

A horizontal width of the rear wall 3522 is greater than a horizontal width of the heat exchange assembly 500 and air passing through the heat exchange assembly 500 preferably flows only into the guide housing suction inlet 3521.

When the width of the rear wall 3522 is narrower than the width of the heat exchange assembly 500, the air passing through the heat exchange assembly 500 may flow to the door assembly 200 through the outside portion of the long-distance fan assembly 400. Through this structure, cold air may cool the door assembly 200 to cause dew formation.

The front surface of the rear wall 3522 preferably faces the front surface of the heat exchange assembly 500 and the rear wall 3522 preferably contacts the front surface of the heat exchange assembly 500. The rear wall 3522 may contact the front surface of the heat exchange assembly 500 to effectively flow the heat-exchanged air to the guide housing suction inlet 3521.

A length in a forward and rearward direction of each of the left wall 3523, the right wall 3524, and the top wall 3525 is referred to as "F1".

At least one of the left wall 3523 or the right wall 3524 defines a guide groove 3550. The guide groove 3550 is disposed in the forward and rearward direction.

The guide groove 3550 supports the fan housing assembly 3400 and guides the forward and rearward movement of the fan housing assembly 3400.

A guide groove 3550 defined in the left wall 3523 is referred to as "a first guide groove 3551" and a guide groove 3550 defined in the right wall 3524 is referred to as "a second guide groove 3552".

The first guide groove 3551 is provided in the storage space (S1) and is concaved towards the left wall 3523. The second guide groove 3552 is concaved towards the right wall 3524 in the storage space (Si).

The first guide groove 3551 is defined on an inner surface of the left wall 3523, extends longitudinally in the forward and rearward direction, and opens toward the inner space (S1). The second guide groove 3552 is defined on an inner surface of the right wall 3524, extends longitudinally in the forward and rearward direction, and opens toward the inner space (S1).

The first guide groove 3551 includes a lower surface 3551*a*, a side surface 3551*b*, and an upper surface 3551*c* and the second guide groove 3522 includes a lower surface 3552*a*, a side surface 3552*b*, and an upper surface 3552*c*.

The lower surface 3551*a* of the first guide groove 3551 and the lower surface 3552*a* of the second guide groove 3552 each support the load of the fan housing assembly 3400.

The first guide roller 3553 and the second guide roller 3554 of the fan housing assembly 3400 described below are moved in the forward and rearward direction along the first guide groove 3551 and the second guide groove 3552.

The first guide groove 3551 and the second guide groove 3552 each provide moving spaces for the first guide roller 3553 and the second guide roller 3554 and each support the first guide roller 3553 and the second guide roller 3554.

<Configuration of Lower Guide Housing>

The lower guide housing 3460 constitutes a lower portion of the guide housing. The lower guide housing 3460 movably supports the fan housing assembly 3400 and guides the fan housing assembly 3400 in a forward and rearward direction.

There is no particular restriction on a shape of the lower guide housing 3460 and the lower guide housing 3460 may have a shape capable of supporting the fan housing assembly 3400 and guiding the frontward and rearward movement.

The lower guide housing 3460 is assembled to the upper guide housing 3520 and provides a storage space (S1) to accommodate the fan housing assembly 3400. In this embodiment, only the rear side of the fan housing assembly 3400 is accommodated and a front side thereof may be exposed outside the storage space S1. In contrast to this embodiment, the storage space Si may accommodate the entire fan housing assembly 3400.

In this embodiment, the lower guide housing 3460 is disposed on the fan casing 320.

The lower guide housing 3460 has a longer length in the forward and rearward direction than that of the upper guide housing 3520 because the lower guide housing 3460 supports the fan housing assembly 3400 and guides the forward and rearward movement of the fan housing assembly 3400. The length in the forward and rearward direction of the lower guide housing 3460 is referred to as "F2". The length (F2) in the forward and rearward direction of the lower guide housing 3460 is longer than the length (F1) in the forward and rearward direction of the upper guide housing 3520.

The lower guide housing 3460 closes the lower surface of the upper guide housing 3520 and movably supports the fan housing assembly 3400. The fan housing assembly 3400 may be moved in the forward and rearward direction by an actuator 3470 when the fan housing assembly 3400 is supported on the lower guide housing 3460.

The lower guide housing 3460 includes a housing base 3462 disposed under the fan housing assembly 3400, a left side wall 3463 and a right side wall 3464 extending upward from both edges of the housing base 3462, a stopper 3465 disposed on at least one of the housing base 3462, the left side wall 3463, or the right side wall 3464 to limit a forward movement of the fan housing assembly 3400, a base guide 3467 disposed on the housing base 3462, interfering with the fan housing assembly 3400 (e.g., in this embodiment, the front fan housing), to guide the forward and rearward direction of the fan housing 3400, and a cable penetration portion 3461 disposed on at least one of the left side wall 3463 or the right side wall 3464, extending longitudinally in a forward and rearward direction, having a long shape, and through which a cable (not shown) coupled to the actuator 3470 passes.

In this embodiment, the lower guide housing 3460 includes a housing rear wall 3466 connecting the housing base 3462, the left side wall 3463, and the right side wall 3464 and disposed at a rear side of the housing base 3462, the left side wall 3463, and the right side wall 3464. The housing rear wall 3466 functions as a stopper to limit the rearward movement of the fan housing assembly 3400.

The housing rear wall 3466 faces the rear wall 3522 of the upper guide housing 3520 and is disposed in front of the rear wall 3522.

An upper end 3466*a* of the housing rear wall 3466 has the same contour as the guide housing suction inlet 3521. For example, the upper end 3466*a* of the housing rear wall 3466 has the same radius of curvature as the radius of curvature of the guide housing suction inlet 3521. The upper end 3466*a* of the housing rear wall 3466 may not cover the guide housing suction inlet 3521 in the forward and rearward direction.

The housing rear wall 3466 connects the housing base 3462, the left side wall 3463, and the right side wall 3464 to improve rigidity of the lower guide housing 3460 and prevents excessive rearward movement of the fan housing assembly 3400.

The stopper 3465 is disposed in front of the housing rear wall 3466. In this embodiment, the stoppers 3465 are disposed on the left side and the right side of the housing base 3562. One of the stoppers 3465 connects the housing base 3462 and the left side wall 3463 and the other one thereof connects the housing base 3462 and the right side wall 3464.

When the fan housing assembly 3400 is excessively moved forward, the fan housing assembly 3400 is interfered by the stopper 3465 and the movement of the fan housing assembly 3400 is stopped.

The cable penetration portion 3461 communicates the outer space of the guide housing with the inner storage space (S1) of the guide housing.

The cable penetration portions 3461 are disposed on the left side wall 3463 and the right side wall 3464. The cable penetration portions 3461 penetrate the left side wall 3463 and the right side wall 3464 in the horizontal direction. The cable penetration portion 3461 extends longitudinally in the forward and rearward direction. The cable penetration portion 3461 provides a space where the cable may be moved in the forward and rearward direction along with the fan housing assembly 3400. In this embodiment, the cable penetration portion 3461 has a length corresponding to the forward and rearward moving distance of the fan housing assembly 3400.

When the cable penetration portion 3461 has a short length that does not correspond to the moving distance of the fan housing assembly 3400, the connection with the actuator 3470 may be separated.

The cable penetration portion 3461 extends longitudinally in the forward and rearward direction and communicates an inner side of the lower guide housing 3460 with an outer side of the lower guide housing 3460. The cable penetration portion 3461 provides a space where a wire connected to the guide motor may also be moved in the forward and rearward direction when the fan housing assembly is moved. The wire may be moved along the cable penetration portion 3461 to provide reliability of connection with the guide motor 3472.

The lower guide housing 3460 includes a fastener 3468 to couple with the fan casing 320 of the short-distance fan assembly 300. The fastener 3468 is disposed on the housing base 3462.

The base guide 3467 is disposed in a forward and rearward direction that is a moving direction of the fan housing assembly 3400. Two base guides 3467 are disposed, a first one thereof is disposed near the left side wall 3463 and a second one thereof is disposed near the right side wall 3464.

The base guide 3467 protrudes upward from an upper surface of the housing base 3462. The base guide 3467 is inserted into a groove defined in the lower surface of the front fan housing 3430. The base guide 3467 limits the horizontal movement of the fan housing assembly 3400.

<Configuration of Rear Fan Housing>

The rear fan housing 3410 forms a rear surface of the fan housing assembly. The rear fan housing 3410 is disposed in front of the heat exchange assembly 500.

In this embodiment, the rear fan housing 3410 is disposed at a front side of the upper guide housing 3520, and more specifically, at a front side of the rear wall 3522. The rear fan housing 3410 is disposed inside the upper guide housing 3520.

The rear fan housing 3410 includes a rear fan housing body 3412 to cover a rear surface of the front fan housing 3430, a fan suction inlet 3411 disposed in the rear fan housing body 3412 and penetrating in a forward and rearward direction, and a fastener 3414 disposed in the rear fan housing body 3412 and coupled to the front fan housing 3430.

A plurality of fasteners 3414 are disposed to be assembled with the front fan housing 3430. The fastener 3414 protrudes radially outward from the rear fan housing body 3412.

The rear fan housing 3410 has a donut shape and defines a fan suction inlet 3411 when viewed from the front. In particular, the rear fan housing body 3412 has a donut shape when viewed from the front.

The rear fan housing 3410 surrounds the fan 3420 together with the front fan housing 3430. The fan 3420 is disposed between the rear fan housing 3410 and the front fan housing 3430.

The rear fan housing 3410 covers the rear surface of the front fan housing 3430 and is assembled to a rear end of the front fan housing 3430.

The rear fan housing 3410 is vertically disposed with respect to the floor. The rear fan housing 3410 faces the front surface of the heat exchange assembly 500.

The fan suction inlet 3411 is parallel to the guide housing suction inlet 3521 and faces each other. A diameter of the fan suction inlet 3411 is less than a diameter of the guide housing suction inlet 3521. The air guide 3510 connects the fan suction inlet 3411 to the guide housing suction inlet 3521. The fan suction inlet 3411 faces the front surface of the heat exchange assembly 500.

The rear fan housing body 3412 is concaved from the front side to the rear side thereof.

The air guide 3510 is disposed at the rear side of the rear fan housing 3410 and is coupled to the rear surface of the rear fan housing 3410. In particular, the air guide 3510 is assembled to the rear fan housing body 3412 and surrounds the fan suction inlet 3411.

<Configuration of Front Fan Housing>

The front fan housing 3430 has a cylindrical shape, is opened in a forward and rearward direction, and provides a flow path structure to guide air expelled by the fan 3420 to a steering grill 3450. In addition, in this embodiment, the fan motor 3440 is assembled to the front fan housing 3430 and the front fan housing 3430 provides an installation structure for installing the fan motor 3440.

The fan motor 3440 is disposed at a front side of the front fan housing 3430, the fan 3420 is disposed at a rear side thereof, and a lower guide housing 3460 is disposed at a lower side thereof.

The front fan housing 3430 is assembled to the lower guide housing 3460 and is movable in the forward and rearward direction with respect to the lower guide housing 3460.

The front fan housing 3430 includes an outer fan housing 3432 opened in a forward and rearward direction and having a cylindrical shape, an inner fan housing 3434 defining an opening opened to a front, disposed in the outer fan housing 3432 and to accommodate the fan motor 3440, a vane 3436 connecting the outer fan housing 3432 to the inner fan housing 3434, and a motor installation portion 3448 disposed in the inner fan housing 3434 and assembled with the fan motor 3440.

The outer fan housing 3432 has a cylindrical shape and defines openings at a front surface and a rear surface thereof and the inner fan housing 3434 is disposed therein. The outer fan housing 3432 may receive a driving force from the actuator 3470 and may be moved in the forward and rearward direction.

An open front surface of the outer fan housing 3432 is referred to as "a first fan opening surface 3431". In this embodiment, the first fan opening surface 3431 has a circular shape when viewed from the front. The rear end of the steering grill 3450 may be inserted into the first fan opening surface 3431.

An inner space of the outer fan housing 3432 opened in the forward and rearward direction is referred to as "a space (S2)". The first fan opening surface 3431 forms a front surface of the space (S2).

The inner fan housing 3434 defines an opening at a front side thereof and has a bowl shape and concaved from a front side to a rear side thereof. A concaved inner space of the inner fan housing 3434 is referred to as "a space (S3)". The fan motor 3440 is disposed in the space (S3) and is coupled to the inner fan housing 3434.

The open front surface of the inner fan housing 3434 is referred to as "a second fan opening surface 3433". The second fan opening surface 3433 may have various shapes. In this embodiment, the second fan opening surface 3433 has a circular shape in consideration of air flow.

The second fan opening surface 3433 forms a front surface of the space (S3). The first fan opening surface 3431 is disposed in front of the second fan opening surface 3433. The second fan opening surface 3433 is disposed inside the first fan opening surface 3431.

The first fan opening surface 3431 and the second fan opening surface 3433 are spaced apart from each other in the forward and rearward direction to provide a space to tilt the steering grill 3450. The rear end of the steering grill 3450 may be disposed between the first fan opening surface 3431 and the second fan opening surface 3433.

A motor installation portion 3438 is disposed in the inner fan housing 3434 to couple the fan motor 3440.

The motor installation portion 3438 is disposed in the space (S3) and protrudes forward from the inner fan housing 3434. The fan motor 3440 further includes a motor mount 3442 and the motor mount 3442 is coupled to the motor installation portion 3438.

The motor installation portion 3438 is disposed in the inner fan housing 3434. The motor installation portions 3438 are disposed at equal distances with respect to a central axis (C1).

A motor shaft of the fan motor 3440 passes through the inner fan housing 3434 and is disposed towards the rear, and is coupled to a fan 3420 disposed at the rear side of the inner fan housing 3434. The inner fan housing 3434 defines a shaft hole 3437 through which the motor shaft of the fan motor 3440 passes.

As the fan motor 3440 is disposed at the front side of the inner fan housing 3434 and is inserted into the space (S3), interference with the discharged air may be minimized.

In particular, a steering base 1070 described below is coupled to the inner fan housing 3434 and closes the space (S3). The fan motor 3440 is disposed outside a flow path of the discharged air to minimize resistance to the discharged air. In particular, the fan motor 3440 is disposed at the front side of the inner fan housing 3434 to avoid resistance to air suctioned from the rear portion thereof.

The inner fan housing 3434 defines a fastening boss 3439 to fix the steering base 1070 and support the steering base 1070. The fastening bosses 3439 are disposed in three places and are spaced apart from one another with the same distance with respect to the central axis (C1).

The fastening boss 3439 and the motor installation portion 3438 are disposed inside the space (S3). When the steering base 1070 is assembled to the fastening boss 3439, the motor installation portion 3438 is concealed by the steering base 1070.

The inner fan housing 3434 is spaced apart from the outer fan housing 3432 by a predetermined distance and the vane 3436 integrates the outer fan housing 3432 with the inner fan housing 3434.

The outer fan housing 3432, the inner fan housing 3434, and the vane 3436 provide straight movement to the air discharged by the fan 3420.

Meanwhile, a first guide roller 3553 and a second guide roller 3554 are disposed outside the front fan housing 3430.

The first guide roller 3553 and the second guide roller 3554 are moved in the forward and rearward direction of the first guide groove 3551 and the second guide groove 3552 disposed in the upper guide housing 3520.

The first guide roller 3553 is inserted into the first guide groove 3551, moved along the first guide groove 3551 in the forward and rearward direction, and is supported by the first guide groove 3551.

The second guide roller 3554 is inserted into the second guide groove 3552, is moved along the second guide groove 3552 in the forward and rearward direction, and is supported by the second guide groove 3552.

The first guide roller 3553 includes a roller shaft coupled to the front fan housing 3430 and a roller rotatably coupled to the roller shaft. The roller shaft is horizontally disposed.

The second guide roller 3554 includes a roller shaft coupled to the front fan housing 3430 and a roller rotatably coupled to the roller shaft. The roller shaft is horizontally disposed.

The roller shaft of the first guide roller 3553 and the roller shaft of the second guide roller 3554 are disposed in a line.

The first guide roller 3553 is disposed on the left side of the front fan housing 3430 and the second guide roller 3554 is disposed on the right side of the front fan housing 3430.

The fan housing assembly 3400 is supported by the first guide roller 3553 and the second guide roller 3554 and a lower end of the fan housing assembly 3400 is spaced apart from a housing base 3462 of the lower guide housing 3460.

When the first guide roller 3553 and the second guide roller 3554 are not provided, the load of the fan housing assembly 3400 is applied to the actuator 3470, and the actuator 3470 may move the fan housing assembly 3400 forward or rearward when the actuator 3470 supports the load of the fan housing assembly 3400.

In this embodiment, the lower end of the fan housing assembly 3400 is spaced apart by the support of the first guide roller 3553 and the second guide roller 3554 to reduce the operating load of the actuator 3470.

<Fan Configuration>

The fan 3420 is disposed between the rear fan housing 3410 and the front fan housing 3430. The fan 3420 is disposed inside the assembled rear fan housing 3410 and front fan housing 3430 and is rotated therein.

The fan 3420 discharges air suctioned through the fan suction inlet 3411 in a diagonal direction. The fan 3420 suctions the air through the fan suction inlet 3411 disposed at a rear side thereof and discharges the air in a circumferential direction. The discharge direction of the air discharged by the fan housing assembly is a diagonal direction. In this embodiment, the diagonal direction refers to a direction between a forward direction and the circumferential direction.

<Configuration of Air Guide and Air Guide Bracket>

The air guide 3510 couples the fan housing assembly 3400 to the guide housing (e.g., in this embodiment, an upper guide housing) and connects the guide housing suction inlet 3521 to the fan suction inlet 3411.

The air guide 3510 defines an opening opened in a forward and rearward direction and introduces air. Specifically, the air guide 3510 connects the rear fan housing 3410 to the upper guide housing 3520 and guides the air suctioned by the guide housing suction inlet 3521 to the fan suction inlet 3411.

The air guide 3510 is made of elastic material and may be expanded or contracted when the front fan housing 3430 moves in the forward and rearward direction.

As the air guide 3510 is made of elastic material, an additional component is needed to couple to the guide housing and the fan housing assembly 3400.

The long-distance fan assembly 400 further includes a first air guide bracket 3530 to couple the air guide 3510 to the guide housing (e.g., in this embodiment, an upper guide housing) and a second air guide bracket 3540 to couple the air guide 3510 to the fan housing assembly 3400 (e.g., in this embodiment, a rear fan housing).

The air guide 3510 is made of elastic material and may have a cylindrical shape.

The air guide 3510 defines an air guide outlet 3511 at a front side thereof (e.g., in this embodiment, toward the fan housing assembly) and defines an air guide inlet 3513 at a rear side thereof (e.g., in this embodiment, toward the guide housing).

The air guide outlet 3511 may have a diameter of G1 and the air guide inlet 3513 may have a diameter of G2. G1 and the G2 may be the same, but in this embodiment, G2 is greater than the G1.

A size of G1 corresponds to a size of the fan suction inlet 3411 and a size of G2 corresponds to a size of the guide housing suction inlet 3521.

In this embodiment, G1 is preferably greater than the diameter of the fan suction inlet 3411 and the fan suction inlet 3411 is disposed inside the air guide outlet 3511.

Similarly, G2 is preferably greater than a diameter (G4) of the guide housing suction inlet 3521.

The first air guide bracket 3530 couples the rear end 3514 of the air guide 3510 to the guide housing (e.g., in this embodiment, the upper guide housing). The second air guide bracket 3540 couples the front end 3512 of the air guide 3510 to the fan housing assembly 3400.

The first air guide bracket 3530 includes a bracket body 3532 having a ring shape and a bracket fastener 3534 disposed on the bracket body 3532 and protruding outward from the bracket body 3532.

The bracket body 3532 has a circular shape and a diameter of the bracket body 3532 is referred to as "G3". The diameter (G3) of the bracket body 3532 is less than the diameter (G2) of the air guide inlet 3513 and is greater than the diameter (G4) of the guide housing suction inlet 3521.

The rear end 3513 of the air guide passes through the guide housing suction inlet 3521 and is disposed on the rear surface of the rear wall 3522 and the bracket body 3532 contacts the rear end 3513 of the air guide to the rear wall 3522.

In this embodiment, a bracket insert 3528 is disposed on the rear wall 3522 of the upper guide housing 3520.

As the bracket insert 3528 is additionally disposed, the guide housing suction inlet 3521 is referred to as a space inward from an inner edge of the bracket insert 3528.

The bracket insert 3528 includes a first insertion wall 3528*a* protruding forward from the rear wall 3522 and a second insertion wall 3528*b* protruding from the first insertion wall 3528*a* toward the central axis (C1) of the fan housing assembly 3400.

The bracket insert 3528 has a forward-concave end due to the structures of the first insertion wall 3528*a* and the second insertion wall 3528*b*.

The bracket body 3532 includes a first bracket body 3535 to face the second insertion wall 3528*b* and a second bracket body 3536 protruding forward from the inner edge of the first bracket body 3535. The first bracket body 3535 and the second bracket body 3536 have a bent shape.

An air guide rear end 3513 is disposed between the first bracket body 3535 and the second insertion wall 3528*b* and the first bracket body 3535 contacts the rear end 3513 with the second insert wall 3528*b*.

The second bracket body 3536 is disposed inside the inner edge of the first insertion wall 3528*a*. An air guide 3510 is disposed between the second bracket body 3536 and the first insertion wall 3528*a*.

A fastening member (e.g., in this embodiment, a screw) is fastened to the rear wall 3522 through the bracket fastener 3534.

A first bracket installation portion 3522*a* in which the bracket fastener 3534 is disposed is disposed on a rear surface of the rear wall 3522. The first bracket installation portion 3522*a* has a concaved shape, and the bracket fastener 3534 is partially inserted, and an operator may align an assembly position of the bracket fastener 3534 using the first bracket installation portion 3522*a*.

A plurality of bracket fasteners 3534 are disposed, and in this embodiment, four bracket fasteners are disposed. The bracket fastener 3534 protrudes radially outward with respect to the central axis (C1) of the fan housing assembly 3400 and is disposed at equal distance with respect to the central axis (C1).

The first air guide bracket 3530 is coupled to the rear surface of the rear wall 3522 to prevent the rear end 3513 of the air guide 3510 from being separated when the fan housing assembly 3400 is moved in the forward and rearward direction.

In addition, there is an advantage in that, as the first air guide bracket 3530 is assembled to the rear surface of the rear wall 3522, the air guide 3510 may be easily replaced.

In addition, as the first air guide bracket 3530 pressurizes the entire rear end 3513 of the air guide 3510 to contact with the rear wall 3522, the entire rear end 3513 of the air guide 3510 is uniformly supported and may be prevented from tearing at a specific position. In particular, the fastening member to fix the first air guide bracket 3530 does not penetrate the air guide 3510 thereby preventing damage to the air guide 3510.

In this embodiment, the second air guide bracket 3540 uses a snap ring.

The second bracket installation portion 3415 is disposed on the rear surface of the rear fan housing 3410 to dispose the second air guide bracket 3540 using the snap ring.

The second bracket installation portion 3415 has a ring shape when viewed from the rear and is disposed outside of the fan suction inlet 3411. The second bracket installation portion 3415 is a rib extending rearward and outward from the rear surface of the rear fan housing 3410 and defines, at an outer side thereof, a groove 3416 into which the second air guide bracket 3540 is inserted. The groove 3416 opens radially outward with respect to the central axis (C1) of the fan housing assembly 3400 and is concaved towards the central axis (C1).

In addition, a guide wall 3417 is disposed on a rear surface of the rear fan housing 3410 to receive the air guide 3510 in a right position. The guide wall 3417 faces the second insertion wall 3528*b* and is disposed in front of the second insertion wall 3528*b*.

When viewed from the rear of the rear fan housing 3410, the guide wall 3417 has a donut shape.

<Actuator Configuration>

The actuator 3470 provides a driving force to move the fan housing assembly 3400 in a forward and rearward direction. The actuator 3470 may move the fan housing assembly 3400 in the forward and rearward direction based on a control signal of a controller.

When the indoor unit is operated, the actuator 3470 moves the fan housing assembly 3400 forward, and when the indoor unit is stopped, the actuator 3470 moves the fan housing assembly 3400 rearward.

The actuator 3470 may move the fan housing assembly 3400 in the forward and rearward direction. For example, the actuator 3470 may include a hydraulic cylinder or a linear motor to move the fan housing assembly 3400 in the forward and rearward direction.

In this embodiment, the actuator 3470 transmits a motor driving force to the fan housing assembly 3400 to move the fan housing assembly 3400 forward or rearward.

In this embodiment, as the first guide roller 3553 and the second guide roller 3554 disposed in the fan housing assembly 3400 each support the load of the fan housing assembly 3400, the operating load occurring on the actuator 3470 based on the forward movement or the rearward movement of the assembly 3400 may be minimized.

In this embodiment, the central axis (C1) of the fan housing assembly and a center of the front discharge outlet 201 is identical to each other. The actuator 3470 moves the fan housing assembly 3400 forward or rearward along the central axis (C1).

The guide housing (e.g., in this embodiment, the upper guide housing or the lower guide housing) guides the forward and rearward movement of the fan housing assembly 3400.

The actuator 3470 includes a guide motor 3472 disposed on the fan housing assembly 3400 to provide a driving force to move the fan housing assembly 3400 in the forward and rearward direction, a guide shaft 3474 disposed in the fan housing assembly 3400 to receive a rotational force of the guide motor 3472 and rotate, a first guide gear 3476 coupled at a left side of the guide shaft 3474 and rotating with the guide shaft 3474, a second guide gear 3477 coupled to a right side of the guide shaft 3474 and rotating together with the guide shaft 3474, a first rack 3478 disposed in the lower guide housing 3460 and engaged with the first guide gear 3476, and a second rack 3479 disposed in the lower guide housing 3460 and engaged with the second guide gear 3477.

In this embodiment, the guide motor 3472, the first guide gear 3476, the second guide gear 3477, and the guide shaft 3474 are each disposed in the front fan housing 3430 and move together when the fan housing assembly 3400 moves forward or rearward.

The first rack 3478 engaged with the first guide gear 3476 and the second rack 3479 engaged with the second guide gear 3477 are each disposed in the lower guide housing 3460.

In contrast to this embodiment, the guide motor 3472, the first guide gear 3476, the second guide gear 3477, and the guide shaft 3474 are each disposed on the lower guide housing 3460 and the first rack 3478 and a second rack 3479 may be disposed under the front fan housing 3430.

The fan housing assembly 3400 moves forward or rearward by the engagement of the racks 3478 and 3479 with the guide gears 3476 and 3477.

In this embodiment, one guide motor 3472 is used and a guide shaft 3474 is disposed to uniformly move the front fan housing 3430. The first guide gear 3476 and the second guide gear 3477 are disposed at both ends of the guide shaft 3474. The guide shaft 3474 is horizontally disposed.

In this embodiment, the first guide gear 3476 is disposed on the left side of the guide shaft 3474 and the second guide gear 3477 is disposed on the right side of the guide shaft 3474.

Racks 3478 and 3479 engaged with the guide gears 3476 and 3477 are disposed on the left side and the right side of the lower guide housing 3460, respectively.

In this embodiment, the first guide gear 3476 and the second guide gear 3477 are disposed on the first rack 3478 and the second rack 3479, respectively. The first guide gear 3476 and the second guide gear 3477 move in the forward and rearward direction along the first rack 3478 and the second rack 3479, respectively.

The first rack 3478 and the second rack 3479 are each disposed on the upper surface of the housing base 3462 of the lower guide housing 3460 and each protrude upward from the housing base 3462.

The first rack 3478 and the second rack 3479 are disposed under the guide gears 3476 and 3477, respectively, and interfere with the guide gears 3476 and 3477 through the engagement, respectively.

The first guide gear 3476 is moved in the forward and rearward direction along the first rack 3478 and the second guide gear 3477 is also moved in the forward and rearward direction along the second rack 3479.

The guide motor 3472 may be disposed at the lower left or lower right of the front fan housing 3430. The motor shaft of the guide motor 3472 may be directly coupled to each of the first guide gear 3476 and the second guide gear 3477.

When the guide motor 3472 is rotated, the first guide gear 3476 and the second guide gear 3477 are simultaneously rotated based on the rotational force of the guide motor 3472 and the left side and the right side of the fan housing assembly 3400 may be moved forward or rearward based on the same force.

The guide motor 3472 is moved together with the fan housing assembly 3400 and the lower guide housing 3460 defines a motor guide groove 3469 to move the guide motor 3472. The motor guide groove 3469 is disposed in the forward and rearward direction, which is a moving direction of the guide motor 3472.

The housing base 3462 of the lower guide housing 3460 defines the motor guide groove 3469 and the motor guide groove 3469 is concaved downward from the housing base 3462.

The motor guide groove 3469 is disposed outside the first rack 3478 or the second rack 3479. The motor guide groove 3469 is concaved downward from the first rack 3478 or the second rack 3479.

The installation and movement space of the guide motor 3472 may be provided due to the motor guide groove 3469 and an overall height of the long-distance fan assembly 400 may be minimized. In particular, the motor guide groove 3469 is concaved downward to directly couple the guide motor 3472 to the first guide gear 3476 or the second guide gear 3477, thereby minimizing a number of power transmission components.

A first guide rail 3480 and the second guide rail 3490 are further disposed between the fan housing assembly 3400 (e.g., in this embodiment, the front fan housing 3430 and the lower guide housing 3460 to easily slide the fan housing assembly 3400.

The first guide rail 3480 couples the left side of the lower guide housing 3460 to the left side of the fan housing assembly. The first guide rail 3480 supports the load of the fan housing assembly and guides the moving direction of the fan housing assembly.

In this embodiment, the first guide rail 3480 is coupled to each of the left side wall 3463 of the lower guide housing 3460 and the front fan housing 3430 to generate the sliding.

The second guide rail 3490 connects the right side of the lower guide housing 3460 to the right side of the fan housing assembly. The second guide rail 3490 supports the load of the fan housing assembly and guides the moving direction of the fan housing assembly.

In this embodiment, the second guide rail 3490 is coupled to each of the right side wall 3464 of the lower guide housing 3460 and the front fan housing 3430 to generate the sliding.

The first guide rail 3480 and the second guide rail 3490 are bilaterally symmetrical to each other with respect to the central axis (C1) of the fan housing assembly.

The first guide rail 3480 and the second guide rail 3490 support a portion of the load of the fan housing assembly to easily implement the forward and rearward movement of the fan housing assembly.

The first guide rail 3480 and the second guide rail 3490 are disposed above the first rack 3478 and the second rack 3479, respectively. The first guide rail 3480 and the second guide rail 3490 support the left side and the right side of the fan housing assembly 3400, respectively, and guide the moving directions of the left side and the right side of the fan housing assembly 3400, respectively.

The first guide rail 3480 and the second guide rail 3490 are bilaterally symmetrical to each other relative to the central axis (C1) to move the left side and the right side of the fan housing assembly at the same speed and distance.

When the moving speed and distance of the left side or right side of the fan housing assembly are non-uniform, the long-distance assembly 400 may move from one side to the other side. In addition, when the moving speed and moving distance of the left side or the right side of the fan housing assembly are non-uniform, the steering grill 3450 may not be accurately inserted into the front discharge outlet 201. The first guide rail 3480 and the second guide rail 3490 minimize friction when the front fan housing 3430 is moved through rolling friction.

As the first guide rail 3480 and the second guide rail 3490 have the same configuration and are bilaterally symmetrical to each other, an exemplary configuration of the first guide rail 3480 is described.

The guide rail 3480 includes a long rail housing 3482 extending longitudinally in a forward and rearward direction and disposed in the guide housing (e.g., in this embodiment, the lower guide housing), a short rail housing 3484 extending in a forward and rearward direction and having a shorter length than that of the long rail housing 3482 and disposed in the fan housing assembly (e.g., in this embodiment, the front fan housing), and a bearing housing 3486 disposed between the long rail housing 3482 and the short rail housing 3484, assembled to be movable relative to each of the long rail housing 3482 and the short rail housing 3484, and to reduce friction when the short rail housing 3484 moves.

The bearing housing 3486 is assembled to the long rail housing 3482 and may be moved along a longitudinal direction of the long rail housing 3482. The short rail housing 3484 is assembled to the bearing housing 3486 and may be moved along the longitudinal direction of the bearing housing 3486.

For example, the short rail housing 3484 is assembled to be movable relative to the bearing housing 3486 and the bearing housing 3486 is assembled to be movable relative to the long rail housing 3482.

The bearing housing 3486 is shorter than the long rail housing 3482 and is longer than the short rail housing 3484. The bearing housing 3486 and the short rail housing 3484 may each slide within the length of the long rail housing 3482.

The length of the long rail housing 3482 corresponds to a length (F2) in the forward and rearward direction of the lower guide housing 3460. In this embodiment, the left side wall 3463 and the right side wall 3464 includes the rail installation portions 3463*a* and 3464*a* on inner surfaces thereof, to which the long rail housing 3482 is coupled. In this embodiment, the rail installation portions 3463*a* and 3464*a* are each disposed above the cable penetration portion 3465.

Figure 16:
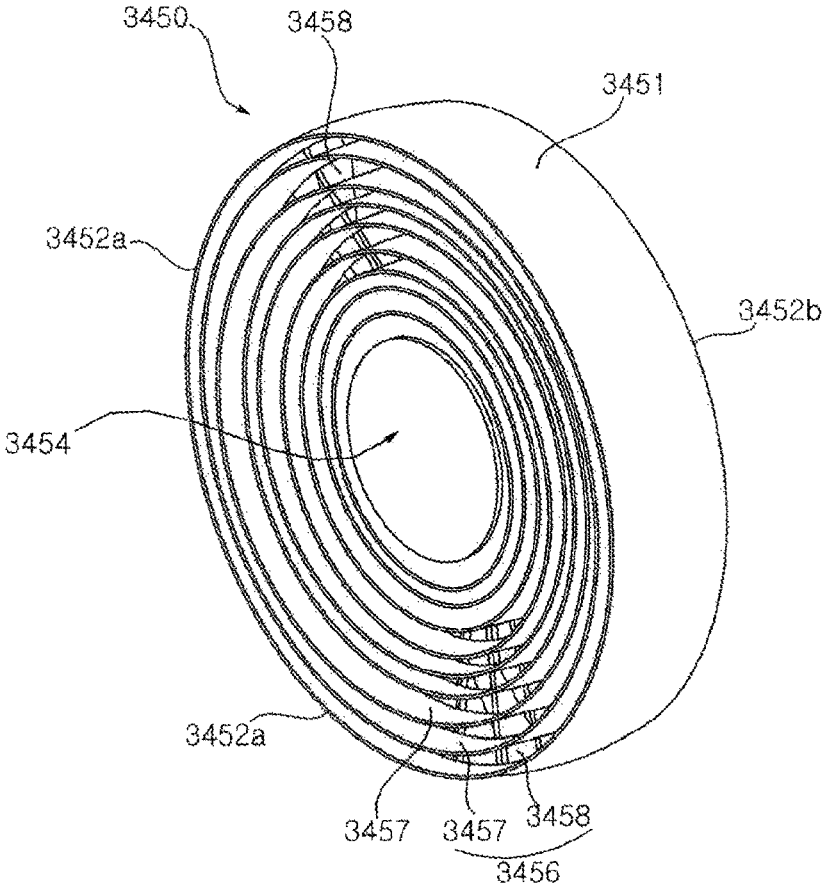
FIG. 16 is a perspective view showing a steering grill in FIG. 10.
Figure 17:
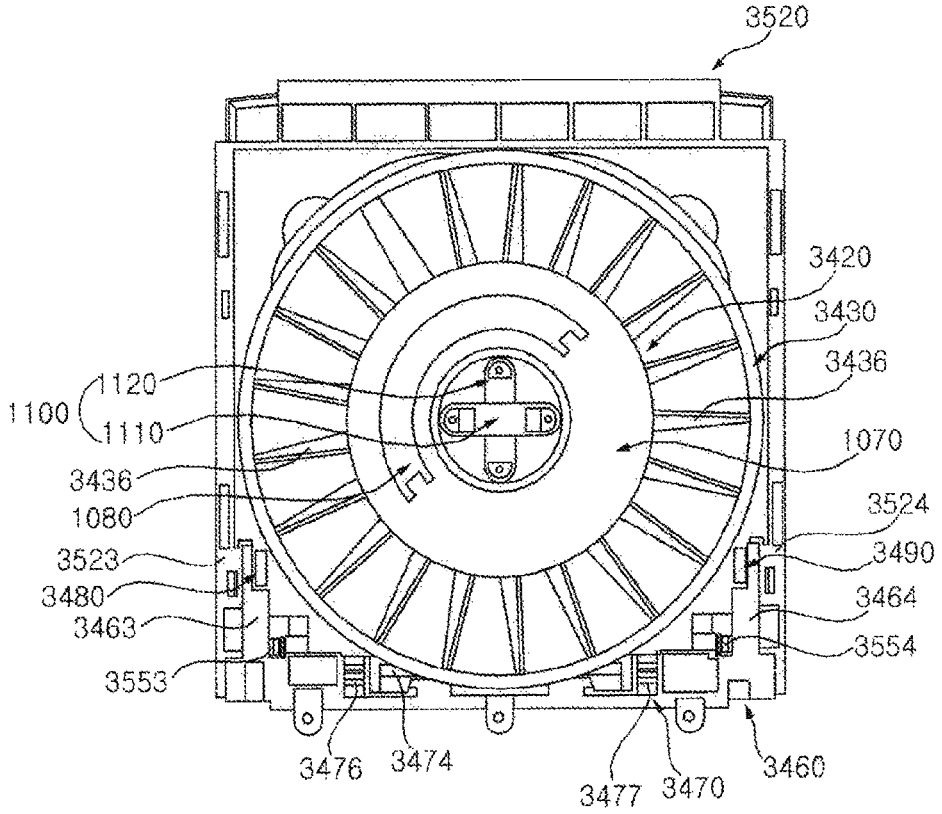
FIG. 17 is a front view showing a fan housing assembly in FIG. 6 from which a steering grill is separated.
Figure 18:
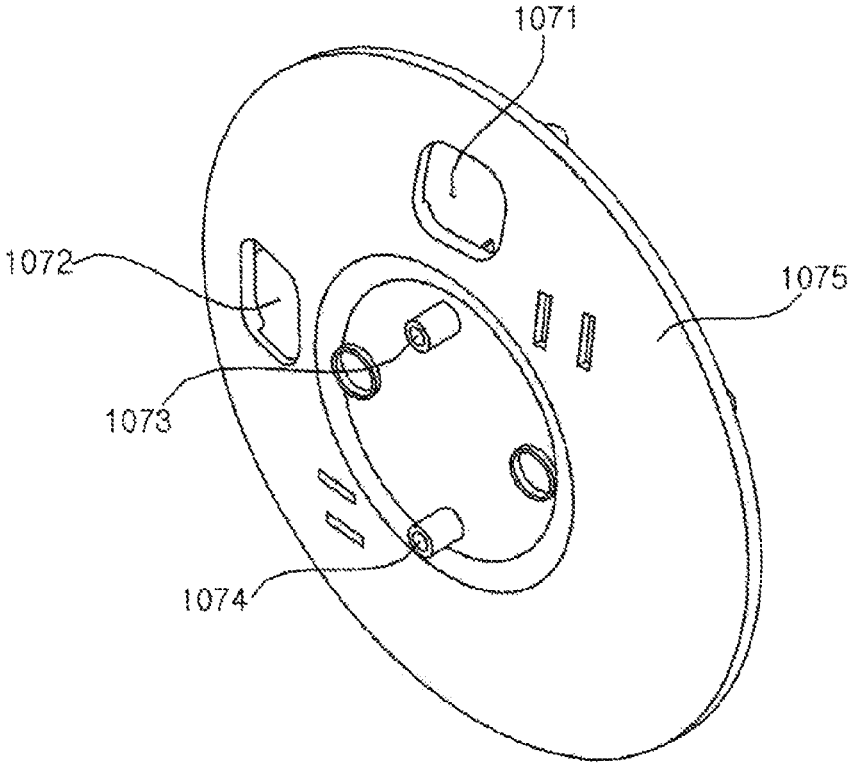
FIG. 18 is a perspective view showing a steering base in FIG. 10.
Figure 19:
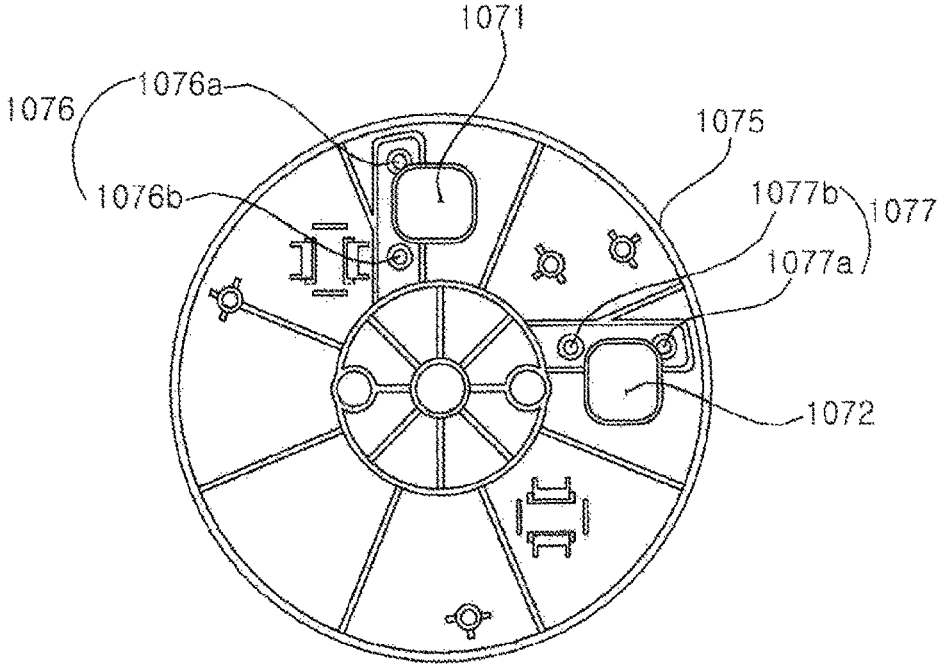
FIG. 19 is a rear view showing a steering base in FIG. 16.
Figure 20:
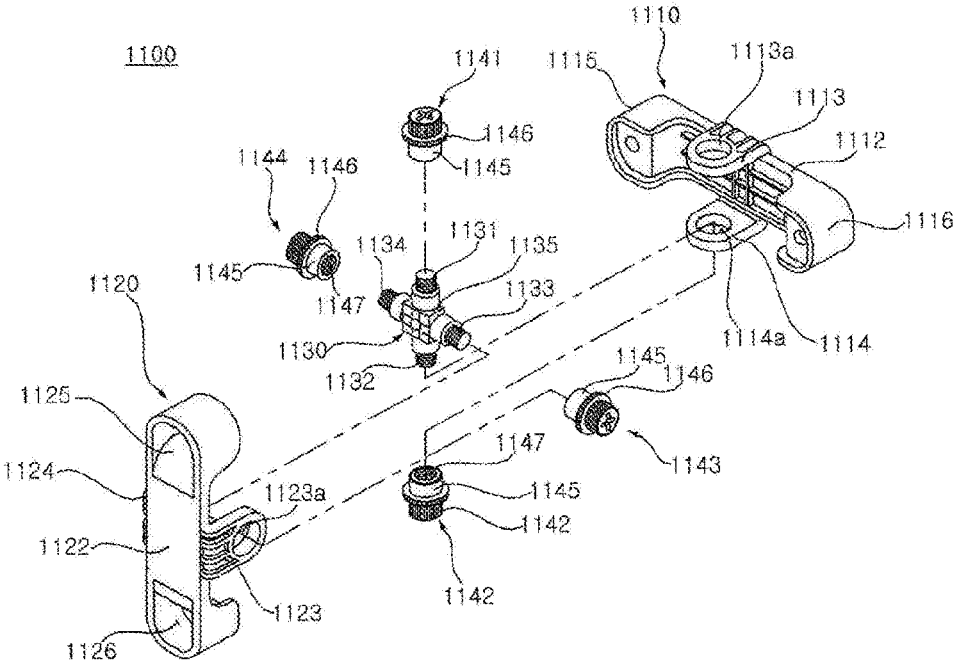
FIG. 20 an exploded perspective view showing a joint assembly in FIG. 10.
Figure 21:
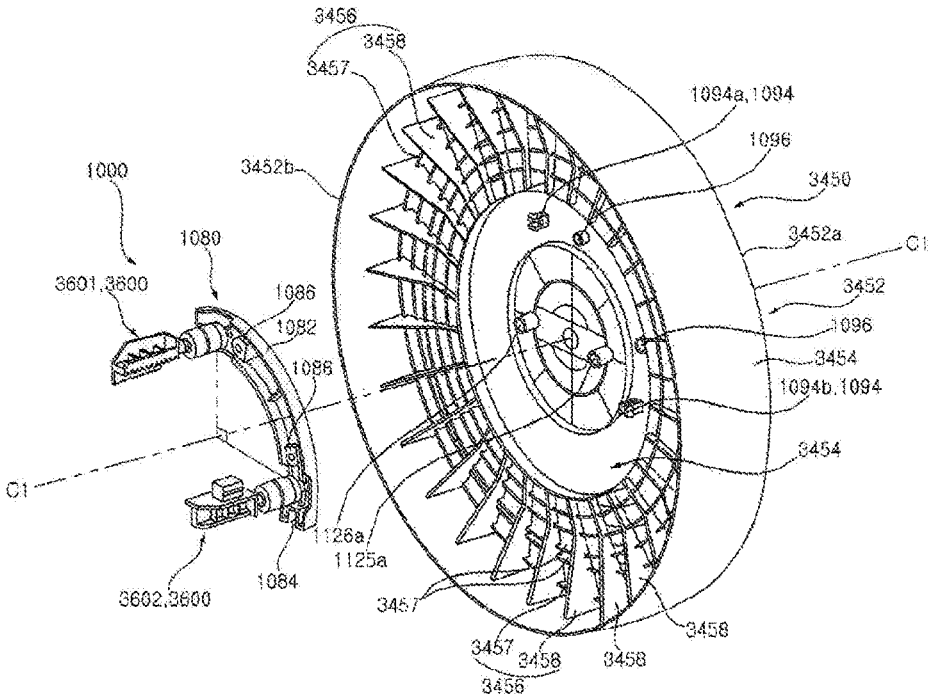
FIG. 21 is an exploded perspective view showing rear surfaces of a steering grill and a steering assembly in FIG. 10.
Figure 22:
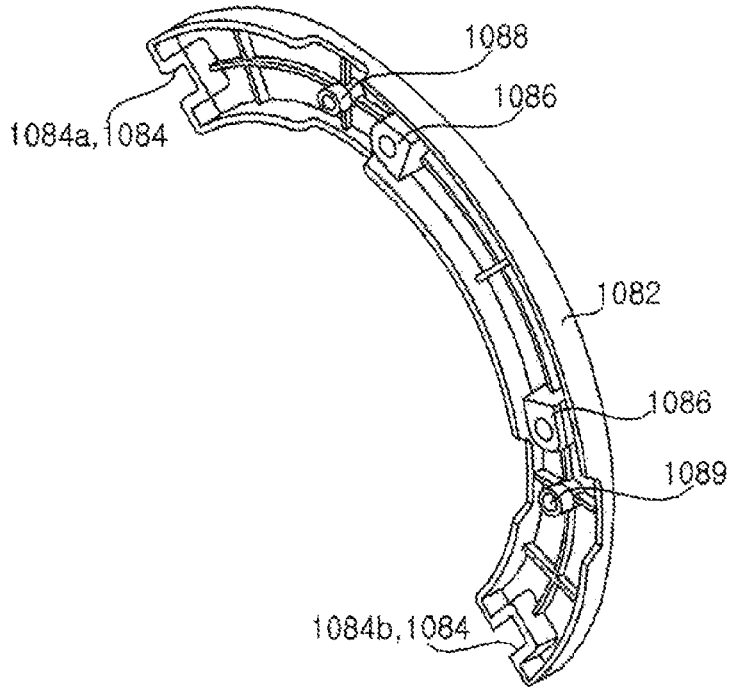
FIG. 22 is a perspective view showing a rear surface of a hub in FIG. 21.
Figure 23:
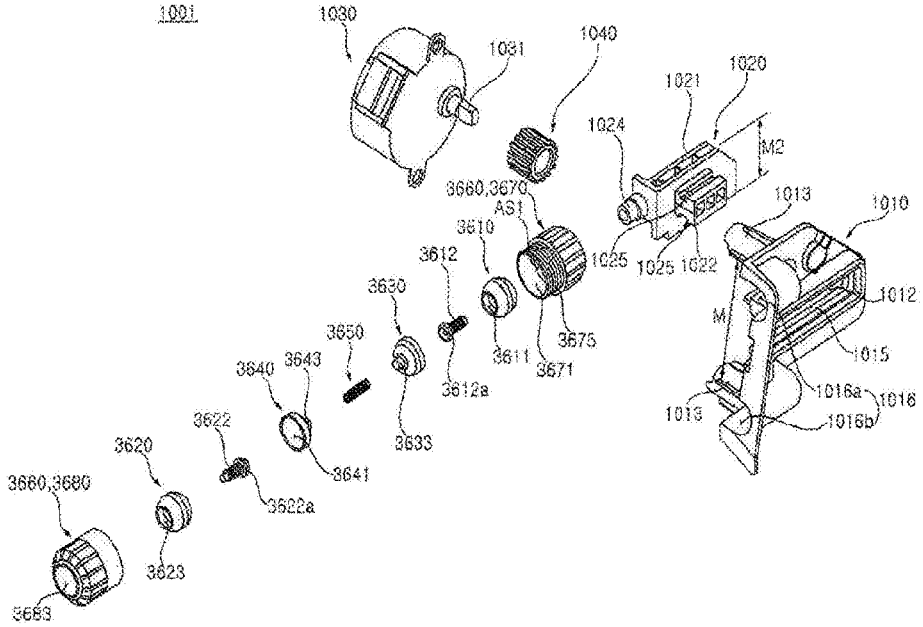
FIG. 23 is an exploded perspective view showing the steering assembly in FIG. 10.
Figure 24:
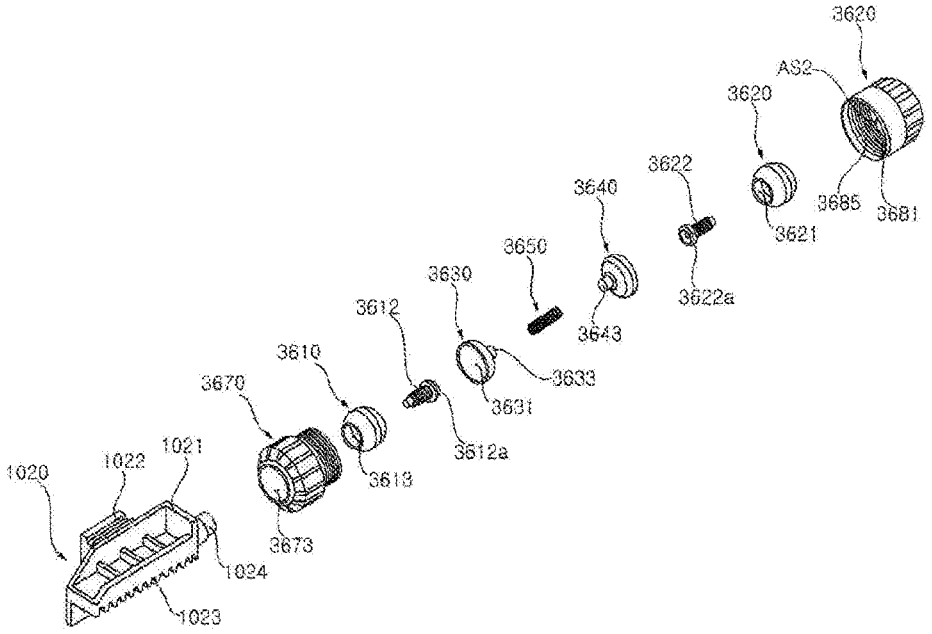
FIG. 24 is an exploded perspective view showing the steering assembly in FIG. 23 viewed from the rear.
Figure 25:
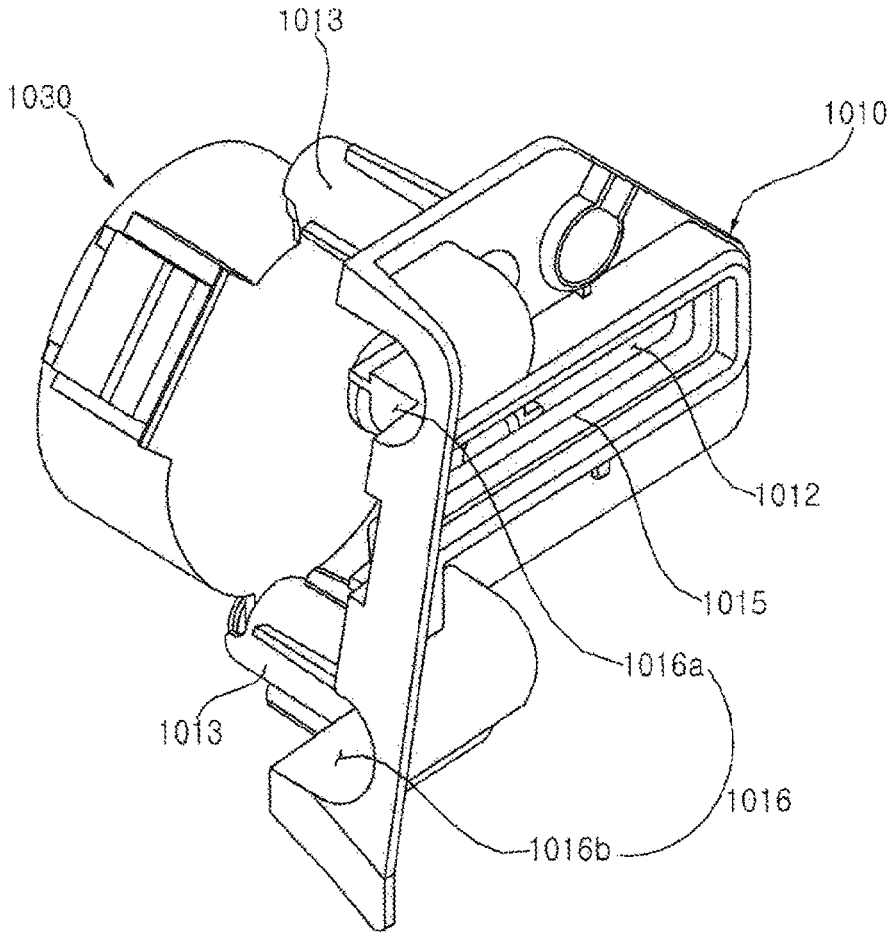
FIG. 25 is a perspective view showing an assembled steering body and steering motor in FIG. 23.
Figure 26:
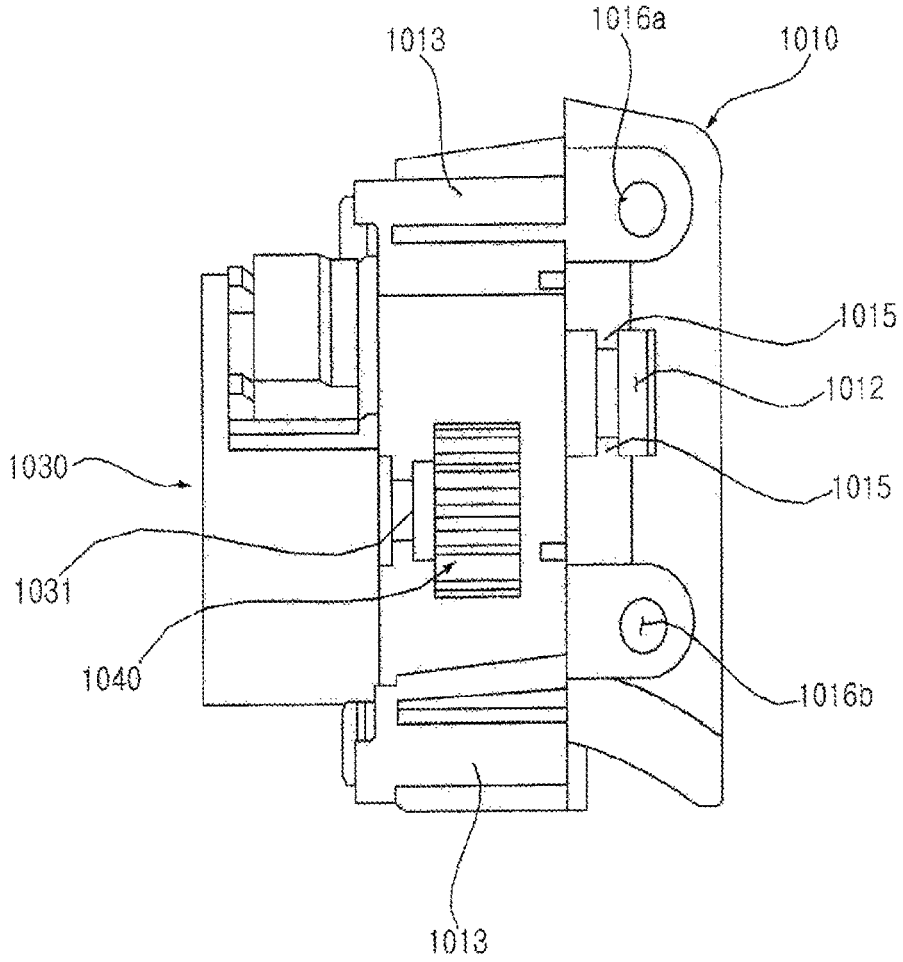
FIG. 26 is a front view showing the assembled steering body and steering motor in FIG. 25.

FIG. 16 is a perspective view showing a steering grill in FIG. 10. FIG. 17 is a front view showing a fan housing assembly in FIG. 6 from which a steering grill is separated. FIG. 18 is a perspective view showing a steering base in FIG. 10. FIG. 19 is a rear view showing the steering base in FIG. 16. FIG. 20 is an exploded perspective view showing a joint assembly in FIG. 10. FIG. 21 is an exploded perspective view showing rear surfaces of a steering grill and a steering assembly in FIG. 10. FIG. 22 is a perspective view showing a rear surface of a hub in FIG. 21. FIG. 23 is an exploded perspective view showing the steering assembly in FIG. 10. FIG. 24 is an exploded perspective view showing the steering assembly in FIG. 23 viewed from the rear. FIG. 25 is a perspective view showing an assembled steering body and steering motor in FIG. 23. FIG. 26 is a front view showing the assembled steering body and steering motor in FIG. 25.

<Configuration of Steering Grill>

The steering grill 3450 is disposed at a front side of the front fan housing 3430. A rear end of the steering grill 3450 is partially inserted into the front fan housing 3430. The steering grill 3450 may be tilted in an upward direction, a downward direction, a leftward direction, a rightward direction, or a diagonal direction when the steering grill 3450 is inserted into the front fan housing 3430.

The rear end of the steering grill 3450 is inserted into a space (S2) of the front fan housing 3430 through a first fan opening surface 3431 of the front fan housing 3430. The rear end of the steering grill 3450 is disposed in front of the inner fan housing 3434.

The steering grill 3450 has a shape corresponding to the first fan opening surface 3431 of the front fan housing 3430. When viewed from the front, the first fan opening surface 3431 has a circular shape and the steering grill 3450 has a circular shape having a smaller diameter than that of the first fan opening surface 3431.

The steering grill 3450 includes a steering housing 3452 having openings at a front surface and a rear surface thereof and defining a space (S4), a steering cover 3454 disposed inside the steering housing 3452 and facing towards the front surface thereof, and a plurality of vanes 3456 disposed in the space (S4) of the steering housing 3452 and connecting the steering housing 3452 to the steering cover 3454.

The front shape of the steering housing 3452 corresponds to the shape of the first fan opening surface 3431 of the outer fan housing 3432. When viewed from the front, the steering housing 3452 has a circular shape.

An outer surface 3451 of the steering housing 3452 has a surface curved in the forward and rearward direction. When the steering grill 3450 is tilted, the outer surface 3451 of the steering housing 3452 having the curved surface may maintain a constant distance from the front fan housing 3430 (e.g., in this embodiment, the outer fan housing 3432).

The outer surface 3451 of the steering housing 3452 may correspond to a radius of rotation of the steering grill 3450. A center of curvature of the outer surface 3451 of the steering housing 3452 may be disposed on the central axis (C1). For example, the outer surface 3451 may have an arc shape with the central axis (C1).

The steering grill 3450 is tiltable when the steering grill 3450 is inserted into the front fan housing 3430. A uniform distance (P) between the outer surface 3451 of the steering housing 3452 and the inner surface of the outer fan housing 3432 may be maintained during tilting due to the structure of the outer surface 3451 of the steering housing 3452 having the arc shape.

During tilting, as the distance (P) between the outer surface 3451 of the steering housing 3452 and the inner surface of the outer fan housing 3432 is minimized, an amount of discharged air leaking to an outside of the steering grill 3450 may be minimized.

When the air discharged through the distance (P) is cooled air, the edge of the front discharge outlet 201 may be cooled to generate dew formation. When the distance (P) is minimized, the dew condensation generated at the edge of the front discharge outlet 201 may be minimized.

In this embodiment, an axis center of the steering housing 3452 is disposed on the axis center (C1) of the fan housing assembly 3400 and is identical to that of the motor shaft of the fan motor 3440.

The steering cover 3454 is disposed in the space (S4) and is vertically disposed. The area and the shape of the steering cover 3454 correspond to the area and the shape of the steering base 1070.

The discharged air flows between the outside of the steering cover 3454 and the inside of the steering housing 3452. As the steering cover 3454 is disposed at the front side of the steering base 1070, air does not flow directly to the steering cover 3454.

The steering cover 3454 is disposed between the front end 3452*a* and the rear end 3452*b* of the steering housing 3452 in the forward and rearward direction.

The steering cover 3454 is connected to a steering assembly 1000 and receives an operating force of the steering assembly 1000.

The vane 3456 includes a circular vane 3457 and a blade vane 3458.

A plurality of circular vanes 3457 are provided, and the circular vanes 3457 have different diameters, and centers of the circular vanes 3457 are disposed on the central axis (C1). For example, the circular vanes 3457 are concentric with each other with respect to the central axis (C1).

A plurality of blade vanes 3458 are provided and the plurality of blade vanes 3458 are radially disposed with respect to the central axis (C1). The circular vane 3457 crosses with the blade vane 3458.

An inner end of the blade vane 3458 is coupled to the steering cover 3454 and an outer end thereof is coupled to the steering housing 3452.

In this embodiment, the steering housing 3452, the steering cover 3454, the circular vane 3457, and the blade vane 3458 are integrated with one another through injection molding.

The steering grill 3450 may be tilted in an upward direction, a downward direction, a leftward direction, a rightward direction, or in any diagonal direction with respect to the axis center (C1). The steering grill 3450 may protrude forward from the front discharge outlet 201.

When the fan housing assembly 3400 is moved forward, the front end 3452*a* of the steering housing 3452 is disposed in front of the front discharge outlet 201 and the rear end 3452*b* of the steering housing 3452 is disposed behind the front discharge outlet 201.

Even when the steering grill 3450 is tilted, the front end 3452*a* of the steering housing 3452 is disposed in front of the front discharge outlet 201 and the rear end 3452*b* of the steering housing 3452 is disposed behind the front discharge outlet 201.

<Configuration of Tilting Assembly>

The steering assembly 1000 is disposed between the steering grill 3450 and a front fan housing 3430. The steering assembly 1000 is disposed at a position where interference with discharged air is minimized.

The steering assembly 1000 is disposed at a front side of the inner fan housing 3434 to minimize interference with the discharged air. In particular, the steering assembly 1000 is disposed at a front side of the fan motor 3440.

In this embodiment, a steering base 1070 is disposed to cover a space (S3) of the inner fan housing 3434 and the steering assembly 1000 is disposed on the steering base 1070. In contrast to this embodiment, the steering assembly 1000 may be disposed on a structure of the front fan housing 3430. For example, the steering assembly 1000 may be disposed on an inner fan housing 3434 or a motor mount 3442 to tilt the steering grill 3450.

The steering assembly 1000 provides a structure in which the steering grill 3450 has no restriction on a tilting direction or sequence. For example, the steering assembly 1000 provides a structure capable of horizontally tilting the steering grill 3450 or tilting in a diagonal direction after vertically tilting the steering grill 3450.

The steering assembly 1000 may immediately tilt the steering grill 3450 from a first direction to a second direction, and as there is no restriction in the tilting direction, the steering of the steering grill 3450 may be immediately implemented.

In this embodiment, the first direction is set to be a horizontal direction and the second direction is set to be a vertical direction. In contrast to this embodiment, the first direction and the second direction may each be arbitrarily changed. In this embodiment, the first direction and the second direction form an angle of 90 degrees.

The steering assembly 1000 includes a steering base 1070 disposed on the front fan housing 3430 and coupled to the rear side of the steering grill 3450, a joint assembly 1100 coupled to each of the steering base 1070 and the steering grill 3450, tiltably assembled to each of the steering base 1070 and the steering grill 3450, a first steering assembly 1001 disposed on the steering base 1070, assembled to be rotatable with the steering grill 3450, to push or pull the steering grill 3450 through the operation of a first steering actuator (e.g., a steering motor 1030 in this embodiment), and tilt the steering grill 3450 around the joint assembly 1100, and a steering assembly 1002 disposed on the steering base 1070, assembled to be rotatable relative to the steering grill 3450, to push or pull the steering grill 3450 through the operation of a second steering actuator (e.g., in this embodiment, the steering motor 1030), and tilt the steering grill 3450 around the joint assembly 1100.

The first steering assembly 1001 and the second steering assembly 1002 are each disposed at the rear side of the steering grill 3450.

The first steering assembly 1001 is assembled to the rear surface of the steering grill 3450 and moves the assembled portion of the steering grill 3450 in the forward and rearward direction. The second steering assembly 1002 is also assembled to the rear surface of the steering grill 3450 and moves the assembled portion of the steering grill 3450 in the forward and rearward direction.

In this embodiment, the first steering assembly 1001 and the second steering assembly 1002 are each disposed in the forward and rearward direction.

When viewed from the front or the rear, a portion at which the first steering assembly 1001 pushes or pulls the steering grill 3450 and a portion at which the second steering assembly 1002 pushes or pulls the steering grill 3450 forms an angle of 90 degrees with respect to the central axis (C1).

In this embodiment, the portion where the first steering assembly 1001 pushes or pulls the steering grill 3450 is vertically disposed above the central axis (C1). The portion where the second steering assembly 1002 pushes or pulls the steering grill 3450 may be disposed on the left side or right side of the central axis (C1).

The joint assembly 1100 provides a tilting center of the steering grill 3450. The joint assembly 1100 is coupled to the rear surface of the steering grill 3450. The joint assembly 1100 provides a rotational center in which the steering grill 3450 may be tilted in any direction. The joint assembly 1100 provides the rotational center to face the steering grill 3450 upward, downward, leftward, rightward, leftward and upward, leftward and downward, rightward and upward, and rightward and downward viewed from the front.

A ball joint may be used as the joint assembly 1100. The ball joint may not provide a structure to support the load of the steering grill 3450, which generates deflection.

The joint assembly 1100 provides a structure to support the load of the steering grill 3450 when the steering grill 3450 is tilted.

In this embodiment, the joint assembly 1100 includes a first joint bracket 1110 assembled to the steering base 1070 and to provide a rotational axis in a first direction (e.g., in this embodiment, a horizontal direction), a second joint bracket 1120 assembled to the steering grill 3450 and to provide a rotational axis in a second direction (e.g., in this embodiment, a vertical direction), and a cross axle 1130 assembled to be rotatable relative to each of the first joint bracket 1110 and the second joint bracket 1120 and to provide the rotational axis in the first direction and the second direction.

As the first joint bracket 1110 and the second joint bracket 1120 have the same configuration, the installation positions thereof may be reversed. When the installation positions are reversed, the first joint bracket 1110 provides the rotational axis in the second direction and the second joint bracket 1120 provides the rotational axis in the first direction.

The first joint bracket 1110 includes a first bracket body 1112 assembled to the steering base 1070, a 1-1 shaft supporter 1113 disposed on the first bracket body 1112 and protruding towards the second joint bracket 1120, and a 1-2 shaft supporter 1114 disposed on the first bracket body 1112, protruding towards the second joint bracket 1120, and facing the 1-1 shaft supporter 1123.

The first bracket body 1112 extends longitudinally, and in this embodiment, the first bracket body 1112 is horizontally disposed. The first bracket body 1112 defines fastening grooves 1115 and 1116 at a first side and a second side of the first bracket body 1112. The first bracket body 1112 defines the fastening grooves 1115 and 1116 that are each concaved and face the steering base 1070.

In this embodiment, the 1-1 shaft supporter 1113 is disposed on the first bracket body 1112 and the 1-2 shaft supporter 1114 is disposed under first bracket body 1112. The 1-1 shaft supporter 1113 and the 1-2 shaft supporter 1114 are disposed vertically.

The second joint bracket 1120 includes a second bracket body 1122 assembled to the steering grill 3450, a 2-1 shaft supporter 1123 disposed on the second bracket body 1122 and protruding towards the first joint bracket 1110, and a 2-2 shaft supporter 1124 disposed on the second bracket body 1122, protruding towards the first joint bracket 1110, and facing the 2-1 shaft supporter 1123.

The second bracket body 1122 extends longitudinally, and in this embodiment, the second bracket body 1122 is vertically disposed. The second bracket body 1122 defines fastening grooves 1125 and 1126 at a first side and a second side of the second bracket body 1122. The fastening grooves 1125 and 1126 defined in the second bracket body 1122 are each concaved and are disposed towards the steering grill 3450.

The 2-1 shaft supporter 1123 and the 2-2 shaft supporter 1124 each define a shaft hole 1123*a* and a shaft hole (not shown) and the shaft hole 1123*a* and the shaft hole (not shown) face each other. The shaft hole 1123*a* and the shaft hole (not shown) are each horizontally disposed.

In this embodiment, the 2-1 shaft supporter 1123 is disposed on the right side thereof and the 2-2 shaft supporter 1124 is disposed on the left side thereof. The 2-1 shaft supporter 1123 and the 2-2 shaft supporter 1124 are horizontally disposed.

The cross axle 1130 provides a vertical rotary shaft and a horizontal rotary shaft. The cross axle 1130 is preferably disposed on the axis center (C1) line.

The cross axle 1130 includes a "+"-shaped cross body 1135, a 1-1 rotary shaft 1131 disposed on the cross body 1135 in the second direction (e.g., in this embodiment, the vertical direction) and rotatably assembled to the 1-1 shaft supporter 1113, a rotary shaft 1131 disposed on the cross body 1135 in the second direction (e.g., in this embodiment, the vertical direction), rotatably assembled to the 1-2 shaft supporter 1114, and disposed at an opposite side of the 1-1 rotary shaft 1131, a 2-1 rotary shaft 1133 disposed on the cross body 1135 in the first direction (e.g., in this embodiment, a horizontal direction) and rotatably assembled to the 2-1 shaft supporter 1123, and a 2-2 rotary shaft 1134 disposed on the cross body 1135 in the first direction (e.g., in this embodiment, the horizontal direction), rotatably assembled to the 2-2 shaft supporter 1124, and disposed at the opposite side of the 21 rotary shaft 1133.

The rotary shafts 1131, 1132, 1133, and 1134 may be inserted into the shaft supporters 1113, 1114, 1123, and 1124, respectively, and may rotate. In this case, due to the length of the cross axle 1130, the shaft supporters 1113, 1114, 1123, and 1124 may be separately manufactured and then assembled to the bracket bodies 1112 and 1122.

In this embodiment, for convenience of assembly and disassembly, the first joint bracket 1110 and the second joint bracket 1120 are integrated with each other through injection molding.

The rotary shafts 1131, 1132, 1133, and 1134 of the cross axle 1130 each include screw threads and shaft caps 1141, 1142, 1143, and 1144 are coupled to the rotary shafts 1131, 1132, 1133, and 1134 by the screws, respectively.

The shaft caps 1141, 1142, 1143, and 1144 have the same configuration, and for convenience of description, a shaft cap assembled to the 1-1 rotary shaft 1131 is referred to as a 1-1 shaft cap 1141. The shaft cap assembled to the 1-2 rotary shaft 1132 is referred to as a 1-2 shaft cap 1142, the shaft cap assembled to the 2-1 rotary shaft 1133 is referred to as a 2-1 shaft cap 1143, and the shaft cap assembled to the 2-2 rotary shaft 1134 is referred to as a 2-2 shaft cap 1144.

The shaft cap has a cylindrical shape and includes a shaft cap body 1145 inserted into and rotated in the shaft hole, a shaft cap supporter 1146 protruding radially and outwardly from the shaft cap body 1145, and supported by the shaft supporter, and a female screw thread 1147 disposed in the shaft cap body 1145.

The 1-1 shaft cap 1141 is inserted into the 1-1 shaft supporter 1113 and is assembled to the 1-1 rotary shaft 1131. The 1-2 shaft cap 1142 is inserted into the 12 shaft supporter 1114 and is assembled to the 1-2 rotary shaft 1132. An assembly direction of the 1-1 shaft cap 1141 and an assembly direction of the 1-2 shaft cap 1142 are opposite to each other.

In this embodiment, the 1-1 shaft cap 1141 and the 1-2 shaft cap 1142 are each vertically disposed and may be rotated in the horizontal direction.

The 2-1 shaft cap 1143 is inserted into the 2-1 shaft supporter 1123 and is assembled to the 2-1 rotary shaft 1133. The 2-2 shaft cap 1144 is inserted into the 22 shaft supporter 1124 and assembled to the 2-2 rotary shaft 1134. The assembly direction of the 2-1 shaft cap 1143 and the assembly direction of the 2-2 shaft cap 1144 are opposite to each other.

In this embodiment, the 2-1 shaft cap 1143 and the 2-2 shaft cap 1144 are each horizontally disposed and may be rotated in the vertical direction.

The steering grill 3450 defines, on a rear surface, fastening bosses 1125*a* and 1126*a* to which the second joint bracket 1120 is coupled. The fastening grooves 1125 and 1126 of the second joint bracket 1120 are inserted into the fastening bosses 1125*a* and 1126*a* of the steering grill 3450 and the second joint bracket 1120 is coupled to the steering grill 34350 through a fastening member (not shown).

The steering base 1070 covers the space (S3) of the inner fan housing 3434.

The steering base 1070 includes a base body 1075 coupled to the inner fan housing 3434, fastening bosses 1073 and 1074 defined on the front surface of the base body 1075 and to which the first joint bracket 1110 is assembled, a first through-hole 1071 penetrating the base body 1075 in the forward and rearward direction and through which the first steering assembly 1001 passes, a second through-hole 1072 penetrating the base body 1075 in the forward and rearward direction and through which the second steering assembly 1002 passes, a first base installation portion 1076 disposed on the rear surface of the base body 1075 and in which the first steering assembly 1001 is disposed, and a second base installation portion 1077 disposed on the rear surface of the base body 1075 and in which the second steering assembly 1002 is disposed.

The first steering assembly 1001 may be disposed at the front side of the steering base 1070. In this embodiment, the first steering assembly 1001 is disposed in the space (S3) to prevent an increase in the length of the fan housing assembly 3400 in the forward and rearward direction due to the installation of the first steering assembly 1001. The first steering assembly 1001 is disposed in the space (S3), is assembled to the rear surface of the steering base 1070, and is assembled to the steering grill 3450 through the first through-hole 1071.

For the same reason, the second steering assembly 1002 is disposed in the space (S3), is assembled to the rear surface of the steering base 1070, and is assembled to the steering grill 3450 through the first through-hole 1071.

The first steering assembly 1001 pushes or pulls the steering grill 3450 and the steering grill 3450 is tilted in the vertical direction with respect to the joint assembly 1100.

The second steering assembly 1002 pushes or pulls the steering grill 3450 and the steering grill 3450 is tilted in a horizontal direction with respect to the joint assembly 1100.

The steering grill 3450 may be tilted diagonally relative to the joint assembly 1100 by combining the operating direction of the first steering assembly 1001 with the operating direction of the second steering assembly 1002.

The first base installation portion 1076 fixes the first steering assembly 1001 and has a boss shape in this embodiment. The second base installation portion 1077 fixes the second steering assembly 1002 and has a boss shape in this embodiment.

The first base installation portion 1076 protrudes rearward from the rear surface of the steering base 1070 and is inserted into the steering body 1010 described below. A fastening member (not shown) is fastened through the steering body 1010 and the first base installation portion 1076.

When the steering body 1010 is fastened, the first base installation portions 1076 are disposed at two places to temporarily fix the fastening position of the steering body 1010. A first one thereof is referred to as a 1-1 base installation portion 1076*a* and a second one thereof is referred to as a 1-2 base installation portion 1076*b*.

The structure of the second base installation portion 1077 is the same as the structure of the first base installation portion 1076.

The second base installation portion 1077 is also disposed in two places. One thereof is referred to as a 2-1 base installation portion 1077*a* and the other one thereof is referred to as a 2-2 base installation portion 1077*b*.

<Steering Assembly Configuration>

The first steering assembly 1001 and the second steering assembly 1002 have the same components and positions thereof assembled to a steering grill 3450 are only different. In this embodiment, an example configuration of the first steering assembly 1001 is described. When the components of the first steering assembly 1001 are needed to be distinguished from the components of the second steering assembly 1002, they are classified into "the first" or "the second".

The first steering assembly 1001 includes a steering body 1010 coupled to the front fan housing 3430 or a steering grill 3450, a steering actuator (e.g., in this embodiment, a steering motor 1030) assembled to the steering body 1010, a moving rack 1020 movably assembled to the steering body 1010 and moving based on operation of the steering actuator, a rack guide 1012 disposed on the steering body 1010, movably assembled to the moving rack 1020 and to guide a moving direction of the moving rack 1020, a steering gear 1040 coupled to the motor shaft 1031 of the steering motor 1030, engaged with the moving rack 1020 and to provide a driving force to the moving rack 1020 based on the operation of the steering motor 1030, and an adjust assembly 3600 assembled to be rotatable relative to the moving rack 1020, assembled to be rotatable relative to the steering grill 3450, and to adjust a distance and an angle between the steering grill 3450 and the moving rack 1020 when the moving rack 1020 moves.

The steering body 1010 may be coupled to the front fan housing 3430 or the steering grill 3450. In this embodiment, the steering body 1010 is disposed on the structure of the front fan housing 3430 in consideration of power supply and cable connection of the steering actuator.

When the steering body 1010 is disposed on the steering grill 3450 which is tilted based on a control signal, there is a problem in that the cable is also tilted. In addition, when the steering body 1010 is assembled to the steering grill 3450, the load of the steering grill 3450 is increased, and there is a problem in that a power of the steering actuator may also be increased to tilt the steering grill 3450.

In this embodiment, the steering actuator is disposed on the steering base 1070 coupled to the front fan housing 3430. In particular, the steering body 1010 is disposed on the rear surface of the steering base 1070 and the adjust assembly 3600 penetrates the steering base 1070 to minimize a separation distance between the steering grill 3450 and the steering base 1070.

The adjust assemblies 3600 pass through through-hole 1071 and 1072 of the steering base 1070 to minimize the distance between the steering base 1070 and the steering grill 3450. In addition, when the distance between the steering base 1070 and the steering grill 3450 is minimized, the length of the adjusting assembly 3600 may be minimized, and relative displacement and a relative angle of the adjusting assembly 3600 may be controlled more precisely.

The steering actuator moves the moving rack 1020 in the forward and rearward direction. A hydraulic cylinder may be used as the steering actuator. In this embodiment, a stepper motor is used as the steering actuator, which is referred to as a steering motor 1030.

The steering motor 1030 is assembled to the steering body 1010 and the moving rack 1020 is disposed between the steering motor 1030 and the steering body 1010.

The rack guide 1012 guides the moving direction of the moving rack 102, and in this embodiment, the rack guide 1012 is disposed in the forward and rearward direction. In this embodiment, the rack guide 1012 is integrated with the steering body 1010. The rack guide 1012 may have a groove or slit shape. In this embodiment, the rack guide 1012 has a slit shape penetrating the steering body 1010 and the movable rack 1020 is inserted into the slit.

The steering motor 1030 is assembled to the steering body 1010. The steering motor 1030 moves the moving rack 1020 in the forward and rearward direction when the steering motor 1030 is coupled to the steering body 1010.

A motor fixer 1013 fixes the steering motor 1030 to the steering body 1010. In this embodiment, the steering motor 1030 is coupled to the steering body 1010 by a fastening means (not shown).

The motor fixer 1013 protrudes from the steering body 1010 towards the steering motor 1030. The motor fixer 1013 is disposed in two places. The moving rack 1020 is disposed between the motor fixers 1013.

The motor fixer 1013 protrudes from the steering body 1010 to provide an installation space of the moving rack 1020. The rack guide 1012 is disposed between the motor fixers 1013. The motor fixer 1013 disposed at a first side thereof is referred to as "a first motor fixer" and the motor fixer 1013 disposed at a second side thereof is referred to as "a second motor fixer". A distance (M1) between the first motor fixer and the second motor fixer is greater than a height (M2) of the moving rack 1020.

The steering body 1010 includes a coupler 1016 to couple with the steering base 1070. The coupler 1016 is disposed in the forward and rearward direction. As the first base installation portion 1076 and the second base installation portion 1077 each have a boss shape, the coupler 1016 have a groove shape corresponding thereto.

A number of couplers 1016 corresponds to a number of first base installation portions 1076 and the coupler 1016 is disposed in two places.

The coupler 1016 disposed on the steering body 1010 of the first steering assembly 1001 is referred to as "a 1-1 coupler 1016*a*" and "a 1-2 coupler 1016*b*". The coupler (not shown) disposed on the steering body 1010 of the second steering assembly 1002 is referred to as "a 2-1 coupler (not shown)" and "a 2-2 coupler (not shown)".

The coupler 1016 is disposed in front of the motor fixer 1013 or the rack guide 1012. The rack guide 1012 is disposed between the 1-1 coupler 1016*a* and the 1-2 coupler 1016*b*.

The steering gear 1040 is a pinion gear. The steering gear 1040 is coupled to the motor shaft 1031.

The moving rack 1020 is moved in the forward and rearward direction by the operation of the steering motor 1030. The moving rack 1020 is movably assembled to the steering body 1010 and moves forward or rearward along the rack guide 1012.

A moving distance of the moving rack 1020 is adjusted according to a number of revolutions of the steering gear 1040 and a moving direction of the moving rack 1020 is determined based on the rotation direction of the steering gear 1040.

The moving rack 1020 includes a moving rack body 1021, a moving rack gear 1023 disposed on the moving rack body 1021 and disposed in a longitudinal direction of the moving rack body 1021, a guide block 1022 disposed on the moving rack body 1021 and movably assembled to the rack guide 1012, and a moving rack coupler 1024 disposed on the moving rack body 1021 and coupled to the structure at the rear side of the adjust assembly 3600.

The guide block 1022, the moving rack gear 1023, and the adjust moving rack coupler 1024 are integrated with the moving rack body 1021.

The moving rack gear 1023 is disposed in the longitudinal direction of the moving rack body 1021. When considering the engagement with the steering gear 1040, the moving rack gear 1023 is preferably disposed on the upper surface or the lower surface of the moving rack body 1021, and in this embodiment, the moving rack gear 1023 is disposed on the lower surface of the moving rack body 1021.

The guide block 1022 is inserted into the rack guide 1012 and is moved. The guide block 1022 and the rack guide 1012 are not engaged with each other in the moving direction thereof, but are engaged with each other in other directions except for the moving direction thereof.

Cross-sections of the guide block 1022 and the rack guide 1012 correspond to each other, which are orthogonal to the moving directions thereof and the guide block 1022 is inserted into the rack guide 1012.

The guide block 1022 defines a guide protrusion 1025 in a moving direction and the rack guide 1012 defines a guide groove 1015 corresponding to the guide protrusion 1025. The guide groove 1015 and the guide protrusion 1025 are engaged with each other in the horizontal direction and the vertical direction except for the moving direction (e.g., in this embodiment, the forward and rearward direction).

In contrast to this embodiment, the guide groove 1015 may be defined in the guide block 1022 and the guide protrusion 1025 may be defined in the rack guide 1012.

<Adjust Assembly Configuration>

The adjust assembly 3600 is disposed on a first steering assembly 1001 and a second steering assembly 1002. The adjust assemblies 3600 have the same configuration.

When the adjust assembly 3600 disposed in the first steering assembly 1001 needs to be distinguished from the adjust assembly 3600 disposed in the second steering assembly 1002, they may be distinguished as a first adjust assembly 3601 and a second adjust assembly 3602. Components of the adjust assembly 3600 are also distinguished in the same manner.

The adjust assembly 3600 corrects a distance and a direction between the steering body 1010 and the steering grill 3450 when the moving rack 1020 moves forward or rearward.

The adjust assembly 3600 connects the steering grill 3450 to the moving rack 1020.

When the steering grill 3450 is tilted, a relative distance between the steering grill 3450 and the moving rack 1020 is varied and the adjust assembly 3600 resolves the variable distance difference. The adjust assembly 3600 supports the tilted steering grill 3450 and maintains the tilted state.

The adjust assembly 3600 corrects the relative displacement and relative angle between the steering grill 3450 and the moving rack 1020 and maintains the tilted state of the steering grill 3450.

In this embodiment, the adjust assembly 3600 corrects the relative displacement and the relative angle through a multi-joint structure.

In this embodiment, the steering assembly 1000 further includes a hub 1080 assembled to the rear surface of the steering grill 3450 and assembled to the adjust assembly 3600. The first steering assembly 1001 and the second steering assembly 1002 are each coupled to the hub 1080.

The hub 1080 includes a hub body 1082 assembled to a steering grill 3450, a hub fitting portion 1084 disposed on the hub body 1082 and coupled to the steering grill 3450, a hub fastener 1086 disposed on the hub body 1082, fastened to the steering grill 3450, a first adjust coupler 1088 and a second adjust coupler 1089 each disposed on the hub body 1082 and coupled to the adjust assembly 3600.

In this embodiment, the first adjust assembly 3601 and the second adjust assembly 3602 are each assembled to the hub body 1082. The hub 1080 may be omitted and the first adjust assembly 3601 and the second adjust assembly 3602 may be directly assembled to the steering grill 3450. In this case, there is a problem in that an assembly process of the first adjust assembly 3601 and the second adjust assembly 3602 is complicated.

In this embodiment, the hub 1080 is assembled to the steering grill 3450 when the first adjust assembly 3601 and the second adjust assembly 3602 are each assembled to the hub 1080. In this case, regardless of the steering grill 3450, the first adjust assembly 3601, the second adjust assembly 3602, and the hub 1080 may be prepared in an assembled state.

As the hub 1080 is assembled to the steering grill 3450, to which the first adjust assembly 3601 and the second adjust assembly 3602 are assembled, assembly may be simplified. In particular, in the structure, when the steering grill 3450 needs to be replaced, the adjust assembly 3600 may not need to be disassembled and the assembled adjust assembly 3600 may be reused without change.

The adjust assembly 3600 includes a first ball hinge 3610 coupled to a moving rack coupler 1024 of the moving rack 1020, a second ball hinge 3620 coupled to the adjust couplers 1088 and 1089 of the hub 1080, a first ball cap 3630 disposed between the first ball hinge 3610 and the second ball hinge 3620 and to cover a portion of an outer surface of the first ball hinge 3610 and be rotatable relative to the first ball hinge 3610, a second ball cap 3640 disposed between the first ball cap 3630 and the second ball cap 3620 and to cover a portion of an outer surface of the second ball hinge 3620 and be rotatable relative to the second ball hinge 3620, an elastic member 3650 disposed between the first ball cap 3630 and the second ball cap 3640, to provide an elastic force to each of the first ball cap 3630 and the second ball cap 3640, contact the first ball cap 3630 to the first ball hinge 3610, and contact the second ball cap 3640 to the second ball hinge 3620, and an adjust housing 3660 to accommodate the first ball hinge 3610, the first ball cap 3630, the elastic member 3650, the second ball cap 3640, and the second ball hinge 3620, in which the adjust couplers 1088 and 1089 are inserted into the front side thereof and the moving rack coupler 1024 is inserted into the rear side thereof.

The elastic member 3650 uses a coil spring. In contrast to this embodiment, various types of elastic members may be used. The coil spring is disposed between the first ball cap 3630 and the second ball cap 3640 and may provide an elastic force when the coil spring is fitted to the first ball cap 3630 and the second ball cap 3640. The coil spring is effective to maintain a right position between the first ball cap 3630 and the second ball cap 3640.

The first ball hinge 3610 and the second ball hinge 3620 each function as a joint. Relative rotation may occur at the first ball hinge 3610 or the second ball hinge 3620.

The first ball hinge 3610 has a spherical shape. The first ball hinge 3610 is coupled to a moving rack coupler 1024 of the moving rack 1020.

The first ball hinge 3610 is coupled to the moving force coupler 1024 by a fastening member 3612. The fastening member 3612 penetrates the first ball hinge 3610 in the forward and rearward direction.

The first ball hinge 3610 defines a first groove 3611 and a second groove 3613 into which the fastening member 3612 is inserted and the first groove 3611 and the second groove 3613 each are concaved in the forward and rearward direction.

The first groove 3611 and the second groove 3613 have the same structure. In this embodiment, the fastening member 3612 is inserted into the first groove 3611. A head 3612*a* of the fastening member 3612 is inserted into the first groove 3611 to prevent the head 3612*a* of the fastening member 3612 from protruding outside the outer surface of the first ball hinge 3610.

A fastening hole (not shown) is connected to the first groove 3611, passes through the first ball hinge 3610, and the fastening hole is provided in a forward and rearward direction. The second groove 3613 is concaved from the rear side to the front side thereof, and the movable rack coupler 1024 is inserted into the second groove 3613.

The fastening member 3612 is coupled to the moving rack coupler 1024 through the first ball hinge 3610.

The second ball hinge 3620 has the same structure as the first ball hinge 3610.

The second ball hinge 3620 defines a first groove 3621 and a second groove 3623 into which the fastening member 3622 is inserted and the first groove 3621 and the second groove 3623 are each concaved in the forward and rearward direction.

The first groove 3621 and the second groove 3623 have the same structure. In this embodiment, the fastening member 3622 is inserted into the first groove 3621. The head 3622*a* of the fastening member 3622 is inserted into the first groove 3621 to prevent the head 3622*a* of the fastening member 3612 from protruding outside the outer surface of the second ball hinge 3620.

A fastening hole (not shown) is connected to the first groove 3621 and passes through the second ball hinge 3620, and is disposed in a forward and rearward direction. The second groove 3623 is concaved from the rear side to the front side thereof and the first adjust coupler 1088 or the second adjust coupler 1089 are inserted. The fastening member 3622 is coupled to the adjust coupler 1088 or the second adjust coupler 1089 through the second ball hinge 3620.

The first ball cap 3630 covers the first groove 3611 of the first ball hinge 3610 and surrounds the outer surface of the first ball hinge 3610. The first ball cap 3630 surrounds a front outer surface of the first ball hinge 3610.

The first ball cap 3630 includes a concaved first ball cap groove 3631 corresponding to the outer surface of the first ball hinge 3610 and a first ball cap protrusion 3633 fitted to the elastic member 3650.

The first ball hinge 3610 is inserted into the first ball cap groove 3631 and the first ball cap groove 3631 minimizes friction with the first ball hinge 3610. The first ball hinge 3610 may contact the first ball cap groove 3631 and rotate.

The first ball cap protrusion 3633 protrudes towards the elastic member 3650. In this embodiment, the first ball cap protrusion 3633 is disposed in the forward and rearward direction and protrudes toward the front side thereof (e.g., toward the steering grill).

The second ball cap 3640 and the first ball cap 3630 have the same configuration and have the different directions.

The second ball cap 3640 covers the first groove 3621 of the second ball hinge 3620 and surrounds the outer surface of the second ball hinge 3620. The second ball cap 3640 surrounds the rear outer surface of the second ball hinge 3620.

The second ball cap 3640 includes a second ball cap groove 3641 that is concaved and corresponding to the outer surface of the second ball hinge 3620 and a second ball cap protrusion 3643 fitted to the elastic member 3650.

The second ball hinge 3620 is inserted into the second ball cap groove 3641 and the second ball cap groove 3641 minimizes friction with the second ball hinge 3620. The second ball hinge 3620 may be rotated in contact with the second ball cap groove 3641.

The second ball cap protrusion 3643 protrudes toward the elastic member 3650. In this embodiment, the second ball cap protrusion 3643 is disposed in the forward and rearward direction and protrudes rearward (e.g., toward the moving rack).

The first ball cap protrusion 3633 and the second ball cap protrusion 3643 are disposed in a line, protrude toward each other, and are disposed in the forward and rearward direction in this embodiment.

The first ball cap groove 3631 and the second ball cap groove 3641 are disposed in opposite directions. For example, when the first ball cap groove 3631 is disposed towards the rear side thereof, the second ball cap groove 3641 is disposed towards the front side thereof.

The adjust housing 3660 accommodates the first ball hinge 3610, the first ball cap 3630, the elastic member 3650, the second ball cap 3640, and the second ball hinge 3620.

The adjust housing 3660 defines a first insertion hole 3673 into which the moving rack coupler 1024 is inserted, at a rear side thereof, and the moving rack coupler 1024 is inserted into the rear side of the adjust housing 3660 through the first insertion hole 3673.

The adjust housing 3660 defines a second insertion hole 3683 at a front side thereof, into which the first adjust coupler 1088 or the second adjust coupler 1089 is inserted and the first adjust coupler 1088 or the second adjust coupler 1089 are inserted into the front side of the adjust housing 3660 through the second insertion hole 3683.

In this embodiment, the adjust housing 3660 includes a first adjust housing 3670 and a second adjust housing 3680.

The first ball hinge 3610, the first ball cap 3630, the elastic member 3650, the second ball cap 3640, and the second ball hinge 3620 may be easily accommodated therein through assembly of the first adjust housing 3670 and the second adjust housing 3680.

The first adjust housing 3670 includes a first adjust housing body 3672 providing a space (AS1), the first insertion hole 3673 defined at a rear side of the first adjust housing body 3672 (e.g., in this embodiment, towards the moving rack coupler 1024) and communicating with the space (AS1), and a first opening surface 3671 disposed at a front side of the first adjust housing body 3672 (e.g., in this embodiment, towards the steering grill) and communicating with the space (AS1).

The second adjust housing 3680 includes a second adjust housing body 3682 providing a space (AS2), the second insertion hole 3683 disposed at the front side of the second adjust housing body 3682 (e.g., in this embodiment, towards the steering grill) and communicating with the space (AS2), and a second opening surface 3681 disposed at the rear side of the second adjust housing body 3682 (e.g., in this embodiment, towards the moving rack coupler 1024) and communicating with the space (AS2).

In this embodiment, the first adjust housing 3670 is coupled to the second adjust housing 3680 by a screw, and to this end, one thereof includes a female screw thread 3685 and the other one thereof includes a male screw thread 3675.

In this embodiment, the female screw thread 3685 is disposed on an inner surface of the second adjust housing body 3682 and the male screw thread 3675 is disposed on an outer surface of the first adjust housing body 3672.

The first ball hinge 3610 and the second ball hinge 3620 are each disposed inside the adjust housing 3660 and the first ball hinge 3610 and the second ball hinge 3620 may each be rotated.

The first ball hinge 3610 may be rotated relative to the steering grill 3450 and the second ball hinge 3620 may be rotated relative to the steering base 1070.

The movable rack coupler 1024 to which the first ball hinge 3610 is coupled may be rotated in the first insertion hole 3673 within a predetermined distance. The adjust couplers 1088 and 1089 to which the second ball hinge 3620 is coupled may be rotated in the second insertion hole 3685 within a predetermined distance.

The first ball hinge 3610 and the second ball hinge 3620 may be rotated independently of each other to respond to the tilting of the steering grill 3450.

Figure 27:
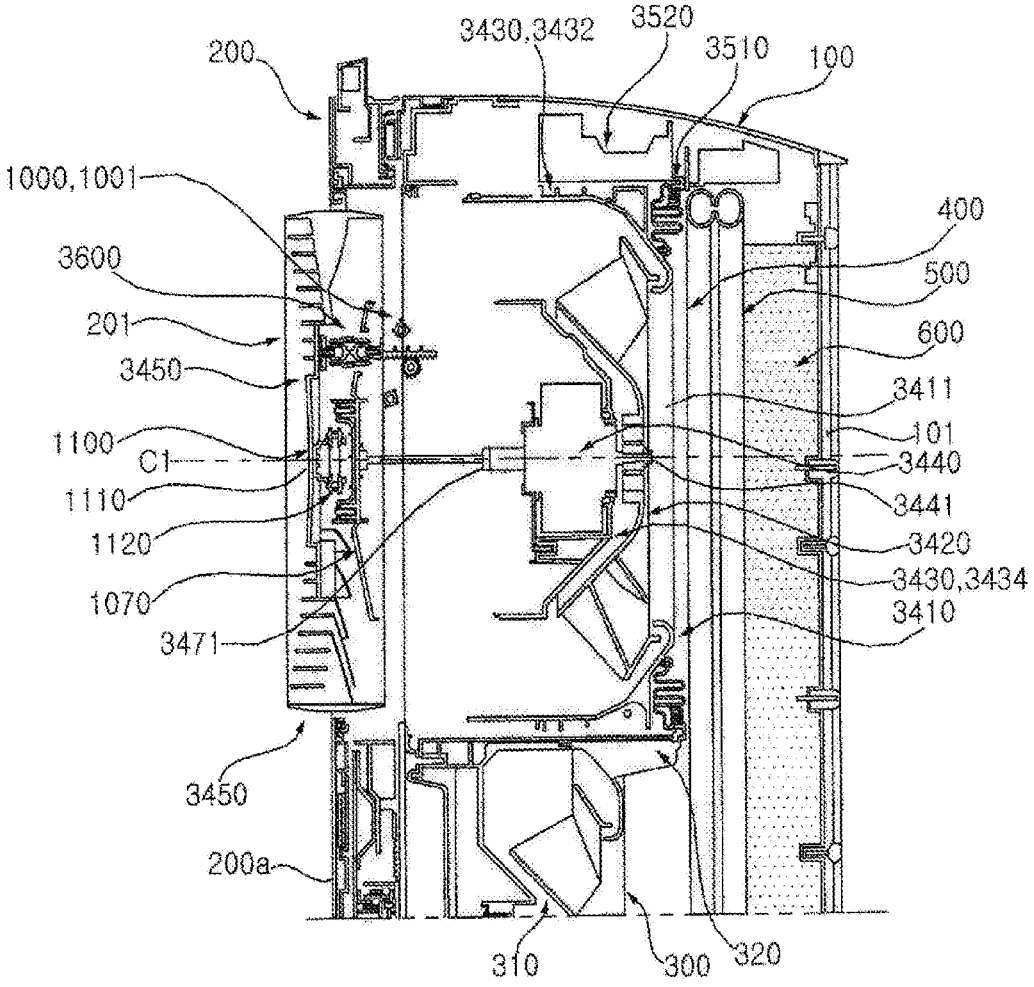
FIG. 27 is an exemplary cross-sectional view showing a steering grill moving forward according to a second embodiment of the present disclosure.

FIG. 27 is an exemplary cross-sectional view showing a steering grill moving forward according to a second embodiment of the present disclosure.

According to the present disclosure, for a long-distance fan assembly, only a steering grill 13450 of a fan housing assembly is moved forward and the long-distance fan assembly includes an actuator 3471 to move the steering grill forward.

The actuator 3471 is disposed in a front fan housing 3430 and is disposed at a rear side of the steering base 1070. The actuator 3471 moves the steering base 1070 coupled to the steering grill 1070 in a forward and rearward direction.

A hydraulic cylinder is used as the actuator 3471.

The actuator 3471 is disposed in a space (S3) of the inner fan housing 3434. A rear end of the actuator 3471 is coupled to the motor mount 3442 and a front end thereof is coupled to the steering base 1070.

When the actuator 3471 is operated, the steering base 1070 and the steering grill 3450 are moved together forward and rearward. In contrast to this embodiment, when the actuator 3471 is operated, the fan housing (e.g., in this embodiment, a front fan housing 3430 and a rear fan housing 3410) and a structure coupled to the fan housing are not moved.

The fan housing assembly may further include a second air guide (not shown) made of elastic material and to connect the front fan housing 3430 and the steering grill 3450. The disposed air guide 3510 in the first embodiment is referred to as "a first air guide" and additionally disposed air guide in the second embodiment is referred to as "a second air guide".

The second air guide surrounds an outer surface of each of the front fan housing 3430 and the steering grill 3450, may be expanded when the steering grill 3450 is moved forward, and may be contracted when the steering grill 3450 is moved rearward.

In this embodiment, even when the steering grill 3450 is only moved forward, a steering assembly 1000 assembled to each of the steering grill 3450 and the steering base 1070 is moved together to implement steering of the steering grill 3450 described in the first embodiment in the same manner.

As the remaining configurations are the same as those in the first embodiment, details thereof are omitted below.

Embodiments of the present disclosure are described with reference to the accompanying drawings. The disclosure may, however, be embodied in many different manners and should not be construed as being limited to the embodiments set forth herein. It is understood that a person having ordinary skill in the art to which the present disclosure pertains would implement this disclosure in other specific manners without changing the technical idea or necessary features of the present disclosure. For this reason, the disclosed embodiments are intended to be illustrative in all aspects, and not restrictive.

The invention claimed is:

1. An air conditioner, comprising:

a case including a suction inlet and a discharge outlet configured to allow an inner space of the case and an indoor space to communicate with each other;

a guide housing disposed in the inner space of the case and including a guide housing suction inlet into which heat-exchanged air is introduced;

a fan housing assembly movably disposed at the guide housing to move in a forward and rearward direction, the fan housing assembly including a fan suction inlet communicating with the guide housing suction inlet, and configured to discharge the air suctioned from the fan suction inlet to the discharge outlet; and an air guide configured to guide the air suctioned from the guide housing suction inlet to the fan suction inlet, made of an elastic material, and configured to expand or contract based on the fan housing assembly movement in the forward and rearward direction, wherein a guide housing suction inlet diameter is greater than a fan suction inlet diameter.

2. The air conditioner of claim 1, further comprising:

a first air guide bracket configured to fix a rear end of the air guide to the guide housing; and a second air guide bracket configured to fix a front end of the air guide to the fan housing assembly.

3. The air conditioner of claim 2, wherein the first air guide bracket comprises:

a bracket body; and a bracket fastener disposed at the bracket body, and configured to protrude from the bracket body, wherein a diameter of the bracket body is less than a diameter of an air guide inlet defined at a rear side of the air guide, and greater than a diameter of the guide housing suction inlet.

4. The air conditioner of claim 3, wherein the guide housing comprises a rear wall including the guide housing suction inlet, wherein the rear end of the air guide passes through the guide housing suction inlet and is disposed at a back surface of the rear wall, the bracket body presses against the rear end of the air guide to allow the rear end of the air guide to contact the rear wall, and the bracket fastener is partially inserted into a first bracket installation portion disposed at the back surface of the rear wall.

5. The air conditioner of claim 2, wherein the fan housing assembly comprises a rear fan housing including the fan suction inlet, and a second bracket installation portion disposed further outwards than the fan suction inlet, and the second bracket installation portion includes a rib extending from a back surface of the rear fan housing rearwards and outwards, and includes, at an outer side thereof, a groove into which the second air guide bracket is inserted.

6. The air conditioner of claim 1, further comprising a heat exchange assembly disposed in the inner space of the case, and disposed at a front of the suction inlet, wherein the guide housing comprises:

an upper guide housing disposed at a front of the heat exchange assembly, and including the guide housing suction inlet; and a lower guide housing assembled to the upper guide housing, and configured to guide the movement of the fan housing assembly in the forward and rearward direction.

7. The air conditioner of claim 6, wherein the upper guide housing comprises a rear wall defining the guide housing suction inlet, and having a width greater than a left-right width of the heat exchange assembly.

8. The air conditioner of claim 7, wherein the lower guide housing comprises:

a housing base disposed under the fan housing assembly;

a left side wall extending upward from an edge of a left side of the housing base;

a right side wall extending upward from an edge of a right side of the housing base; and a housing rear wall connecting the housing base, the left side wall and the right side wall, and disposed at rear side of the housing base, the left side wall and the right side wall, wherein an upper end of the housing rear wall has a same contour as the guide housing suction inlet.

9. The air conditioner of claim 6, wherein the fan housing assembly comprises:

a rear fan housing including the fan suction inlet and disposed at the upper guide housing;

a fan disposed in front of the rear fan housing, and configured to discharge the air suctioned from the fan suction inlet in a diagonal direction; and a front fan housing disposed in front of the rear fan housing, coupled to the rear fan housing, and disposed in front of the fan, and configured to guide the air pressurized by the fan in the diagonal direction.

10. The air conditioner of claim 1, wherein the fan suction inlet and the guide housing suction inlet are parallel with each other, and disposed to face each other.

* * * * *